US006079076A

United States Patent [19]

Berfield

[11] Patent Number: 6,079,076

[45] Date of Patent: Jun. 27, 2000

[54] VACUUM CLEANER COLLECTION BAG

[75] Inventor: Robert C. Berfield, Jersey Shore, Pa.

[73] Assignee: Shop-Vac Corporation, Williamsport, Pa.

[21] Appl. No.: 08/903,635

[22] Filed: Jul. 31, 1997

[51] Int. Cl.[7] ..... A47L 7/00

[52] U.S. Cl. ..... 15/321; 15/326; 15/347; 15/353

[58] Field of Search ..... 15/353, 321, 326, 15/347

[56] References Cited

U.S. PATENT DOCUMENTS

| | | | |
|---|---|---|---|
| 1,691,164 | 11/1928 | Monk | 15/321 |
| 1,849,093 | 3/1932 | Janette . | |
| 2,049,603 | 8/1936 | Dietenberger | 15/14 |
| 2,292,435 | 8/1942 | Crites | 15/321 |
| 2,643,732 | 6/1953 | Keen | 183/35 |
| 2,657,416 | 11/1953 | Smith | 15/331 |
| 2,909,800 | 10/1959 | Grindle et al. | 15/321 |
| 2,932,844 | 4/1960 | O'Connor | 15/321 |
| 2,972,769 | 2/1961 | Keating et al. | 15/321 |
| 3,137,023 | 6/1964 | Klinge et al. . | |
| 3,496,592 | 2/1970 | Jones | 15/321 |
| 3,552,100 | 1/1971 | Ekenberg | 55/337 |
| 3,605,786 | 9/1971 | Machin, Jr. | 137/205 |
| 3,614,797 | 10/1971 | Jones | 8/158 |
| 3,720,977 | 3/1973 | Brycki | 15/321 |
| 3,828,390 | 8/1974 | Cuter | 15/321 |
| 3,977,797 | 8/1976 | Paterson | 401/15 |
| 4,072,483 | 2/1978 | Doyle et al. | 55/372 |
| 4,080,104 | 3/1978 | Brown, Jr. | 417/17 |
| 4,138,761 | 2/1979 | Nauta | 15/353 |
| 4,153,968 | 5/1979 | Perkins | 15/321 |
| 4,171,208 | 10/1979 | Lowder | 55/216 |
| 4,179,768 | 12/1979 | Sawyer | 15/352 |
| 4,185,354 | 1/1980 | Brazier | 15/321 |
| 4,216,563 | 8/1980 | Cyphert | 15/321 |
| 4,218,805 | 8/1980 | Brazier | 15/321 |
| 4,226,000 | 10/1980 | Tribolet | 15/321 |
| 4,267,617 | 5/1981 | Brown et al. | 15/320 |
| 4,287,636 | 9/1981 | Brazier | 15/321 |
| 4,314,385 | 2/1982 | Wimsatt et al. | 15/321 |
| 4,318,202 | 3/1982 | Holman | 15/328 |
| 4,329,756 | 5/1982 | Chicoine et al. | 15/321 |
| 4,348,783 | 9/1982 | Swanson et al. | 15/320 |
| 4,353,145 | 10/1982 | Woodford | 15/321 |
| 4,397,057 | 8/1983 | Harbeck | 15/321 |
| 4,458,377 | 7/1984 | Frohbieter | 15/320 |
| 4,466,155 | 8/1984 | Grave | 15/321 |
| 4,654,926 | 4/1987 | McCambridge | 15/327 D |
| 4,667,364 | 5/1987 | Meili | 15/320 |
| 4,675,935 | 6/1987 | Kasper et al. | 15/319 |
| 4,741,069 | 5/1988 | Helm et al. | 15/320 |
| 4,776,058 | 10/1988 | Garner et al. | 15/320 |
| 4,788,738 | 12/1988 | Monson et al. | 15/320 |
| 4,800,612 | 1/1989 | Valentine | 15/314 |
| 4,800,613 | 1/1989 | Blase et al. | 15/321 |
| 4,801,376 | 1/1989 | Kulitz | 210/123 |
| 4,809,396 | 3/1989 | Houser | 15/320 |
| 4,827,562 | 5/1989 | Blase et al. | 15/353 |
| 4,845,793 | 7/1989 | Meyer | 15/328 |
| 4,847,943 | 7/1989 | Blase et al. | 15/352 |
| 4,864,680 | 9/1989 | Blase et al. | 15/321 |
| 4,934,017 | 6/1990 | Kent | 15/321 |
| 4,949,424 | 8/1990 | Shero | 15/321 |
| 4,956,891 | 9/1990 | Wulff | 15/320 |
| 4,974,282 | 12/1990 | Stoltz et al. | 15/321 |
| 4,976,850 | 12/1990 | Kulitz | 210/104 |

(List continued on next page.)

FOREIGN PATENT DOCUMENTS

| | | | |
|---|---|---|---|
| 0 012 337 A1 | 6/1980 | European Pat. Off. | A47L 11/30 |

*Primary Examiner*—David A. Redding
*Attorney, Agent, or Firm*—Marshall, O'Toole, Gerstein, Murray & Borun

[57] ABSTRACT

A vacuum cleaner has an electric motor driving an air impeller for creating suction and a pump which draws liquid material through an inlet tube from the bottom of a tank and expels it from the tank. The vacuum cleaner also includes a non-water soluble collection bag that attaches to a tank inlet and is disposed within the tank. The collection bag filters large particulate material out of the material which is vacuumed into the tank.

11 Claims, 21 Drawing Sheets

U.S. PATENT DOCUMENTS

| | | | |
|---|---|---|---|
| 4,977,638 | 12/1990 | Best | 15/301 |
| 5,012,549 | 5/1991 | Williams et al. | 15/320 |
| 5,048,148 | 9/1991 | Gleadall | 15/321 |
| 5,086,537 | 2/1992 | McDowell et al. | 15/353 |
| 5,099,543 | 3/1992 | Wade | 15/321 |
| 5,125,126 | 6/1992 | Bonnant | 15/321 |
| 5,134,748 | 8/1992 | Lynn | 15/321 |
| 5,174,730 | 12/1992 | Nieuwkamp et al. | 417/366 |
| 5,182,834 | 2/1993 | Wright et al. | 15/330 |
| 5,184,370 | 2/1993 | Jung | 15/321 |
| 5,189,755 | 3/1993 | Yonkers et al. | 15/321 |
| 5,210,902 | 5/1993 | Lee et al. | 15/321 |
| 5,263,225 | 11/1993 | Winters | 15/353 |
| 5,267,370 | 12/1993 | Worwag | 15/319 |
| 5,287,587 | 2/1994 | Yonkers et al. | 15/320 |
| 5,287,590 | 2/1994 | Yonkers et al. | 15/321 |
| 5,289,611 | 3/1994 | Yonkers et al. | 15/321 |
| 5,388,301 | 2/1995 | Bosyj et al. | 15/327.1 |
| 5,430,910 | 7/1995 | Wiley | 15/321 |
| 5,455,983 | 10/1995 | Crouser et al. | 15/331 |
| 5,455,984 | 10/1995 | Blase | 15/339 |
| 5,465,455 | 11/1995 | Allen | 15/319 |
| 5,469,598 | 11/1995 | Sales | 15/321 |
| 5,526,547 | 6/1996 | Williams et al. | 15/320 |
| 5,535,500 | 7/1996 | Stephens et al. | 29/453 |

VACUUM CLEANER COLLECTION BAG

FIELD OF THE INVENTION

The present invention relates to vacuum cleaners, and more particularly to wet/dry vacuum cleaners having collection bags within their tank for filtering out large particulate material.

BACKGROUND ART

Tank-type vacuum cleaners are capable of receiving dry materials such as debris or dirt and may also be used for suctioning liquids. When the tank is full, an upper vacuum assembly (which often includes a motor and an air impeller) is removed and the contents are dumped out. If the vacuum cleaner is used on liquid material, the tank, when at or near capacity, may be very heavy so that lifting the tank, to pour the contents into a sink or the like, is difficult. Even tilting the tank to pour the contents into a floor drain may be unwieldy when the liquid level in the tank is high.

One solution to the difficulties encountered in emptying liquid from vacuum tanks has been to provide an outlet at the bottom of the tank. Such a solution is satisfactory when the contents of the tank are emptied into a floor drain; however, if no floor or other low-placed drain is available the tank must be lifted to a sink or similar disposal site. In such cases the outlet at the bottom of the tank is of little value.

A second solution to emptying a vacuum tank of liquid is to provide a pump, usually with a motor located outside of or in the bottom of the tank. The pump removes liquid through a lower portion of the tank and expels it through a hose to waste. While such pumps are generally effective, they may be very costly. The pump requires not only a pump impeller and hoses but also its own electric motor, power cords, and switches. The expense of such items may be significant in the context of the overall cost of a vacuum cleaner, particularly those designed for residential use. Such pumps may also reduce the effective capacity of the vacuum tank or interfere with operation when the vacuum cleaner is used on dry materials. In addition, it may also be necessary to provide costly or complicated structures to prime the pump, if it is not located in the bottom of the tank.

It may also be desirable to filter debris out of the liquid entering the tank in order to minimize interference with the pump impeller and to avoid putting large debris into the user's sink or drain. Vacuum cleaners often have filter bags for capturing debris which sit inside the tank. However, such bags are generally made of a paper-type material and, therefore, are unsuitable for wet pick-up.

SUMMARY OF THE INVENTION

In accordance with an aspect of the present invention, the vacuum cleaner includes an air impeller for creating low pressure in the vacuum cleaner and a tank in communication with the air impeller. The tank has an inlet, and a collection bag, made of a non-water soluble material (e.g., a nylon mesh), is connected to the tank inlet. The vacuum cleaner may further include a pump impeller for pumping material out of the tank. The collection bag may have a collar which is used to attach the collection bag to the tank inlet.

The collection bag may include a filter section having a closure flap and an inlet collar attached to the filter section. The inlet collar may include a flexible sleeve and a reinforcement portion such that the flexible sleeve is sandwiched between the filter section and the reinforcement portion, and the flexible sleeve slides over the inlet.

Other features and advantages are inherent in the vacuum cleaner claimed and disclosed or will become apparent to those skilled in the art from the following detailed description in conjunction with the accompanying drawings.

DESCRIPTION OF THE PREFERRED EMBODIMENT

Figure 1:
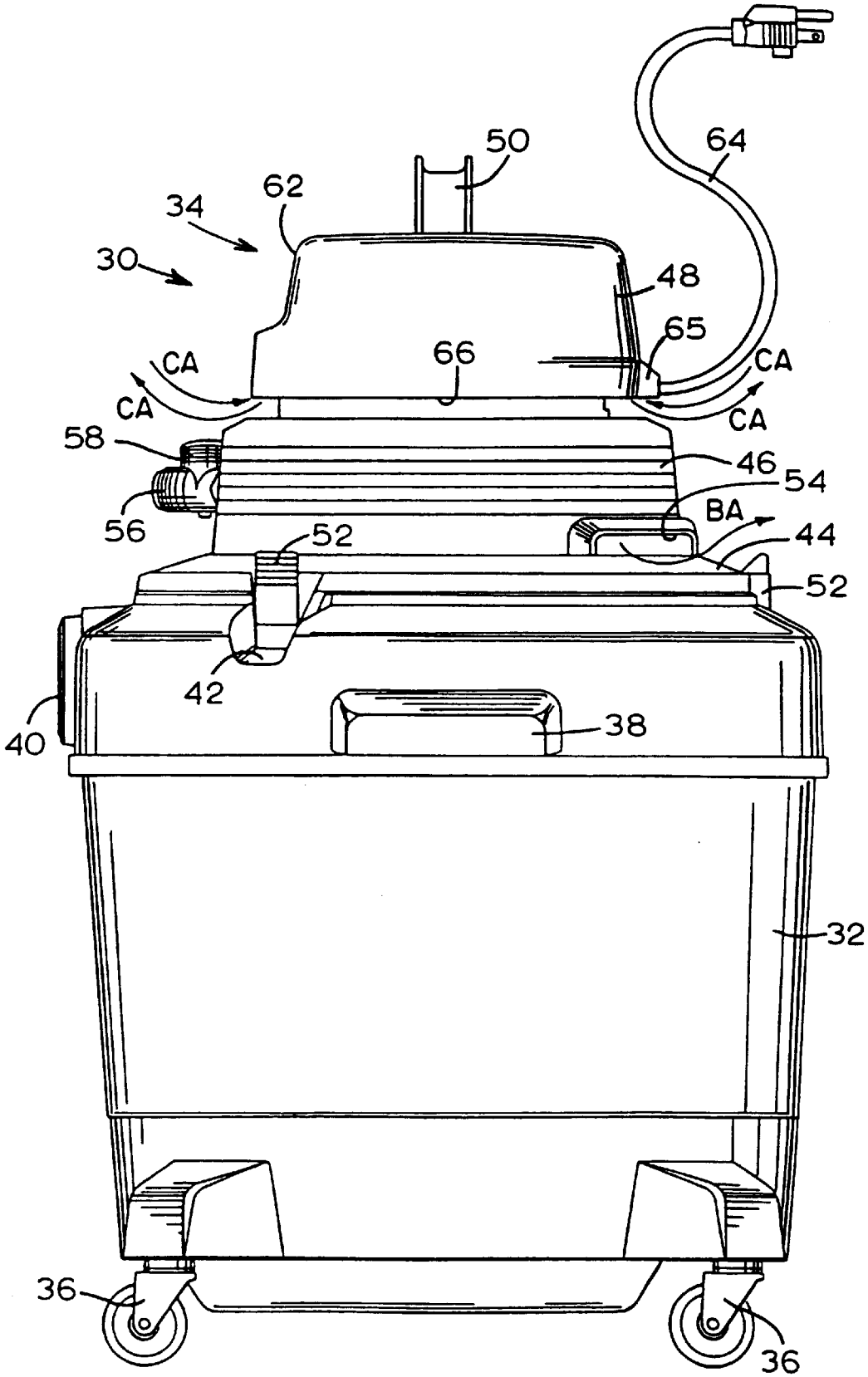
FIG. 1 is a side elevational view of a vacuum cleaner of the present invention.
Figure 2:
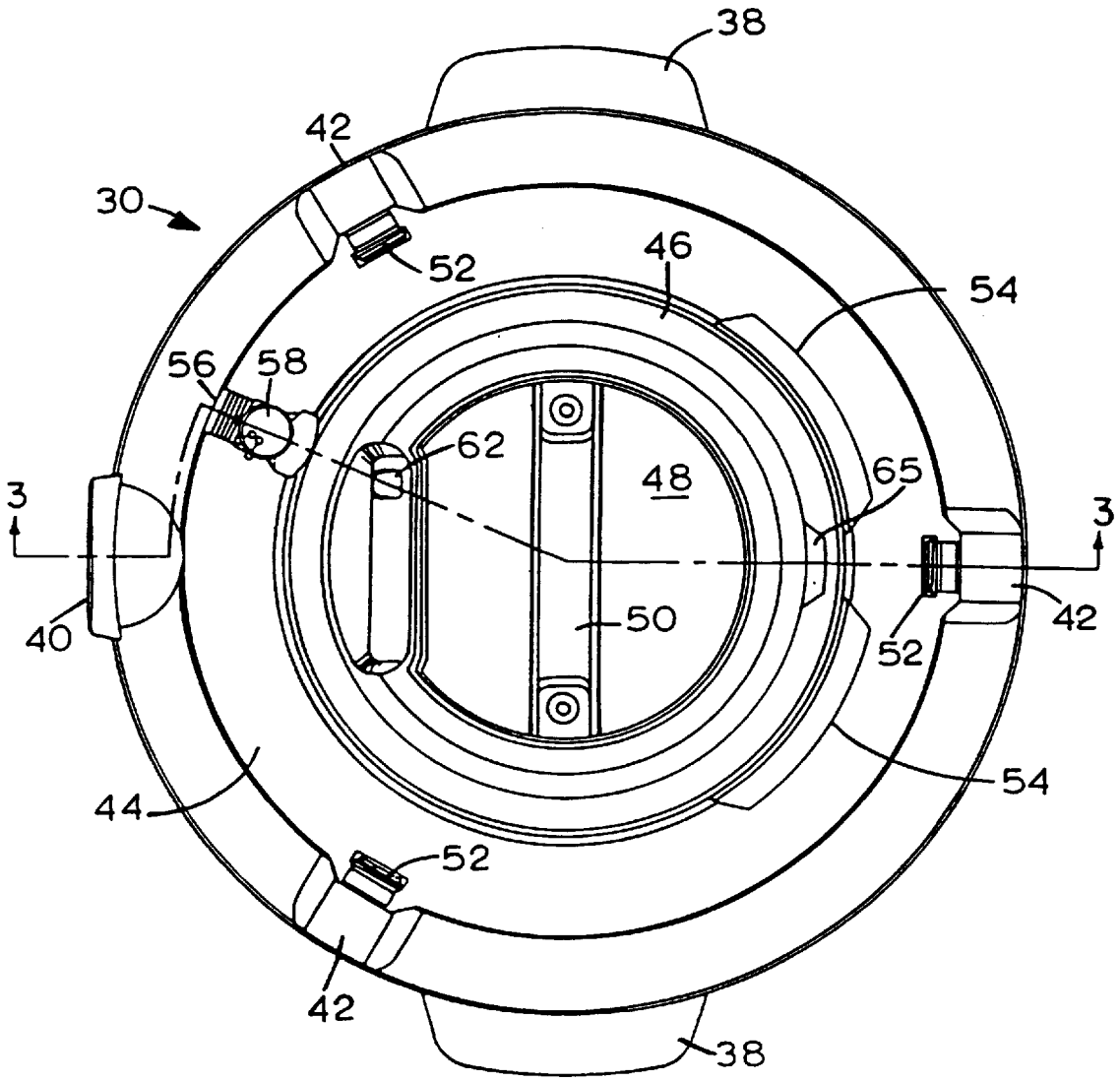
FIG. 2 is a top plan view of a vacuum cleaner of the present invention.

Referring initially to FIGS. 1 and 2, a vacuum cleaner of the present invention, indicated generally at 30, has a tank 32 and an upper vacuum assembly, indicated generally at 34.

The tank 32 is supported by casters 36 and includes a pair of handles 38. The handles 38 may be used to assist the user in lifting and moving the vacuum cleaner 30. The tank 32 further defines an inlet 40 and a number of latch recesses 42. The inlet 40 may be fitted with a vacuum hose (not depicted) for applying suction at desired locations.

The tank 32 supports the upper vacuum assembly 34. The upper vacuum assembly 34 includes a lid 44, a motor housing 46, a cover 48, and a handle 50. The upper vacuum assembly 34 may be of conventional construction. Except for the pump, mechanical shut-off and override system, and priming apparatus described below, the upper vacuum assembly 34 and its associated components may be similar to a Shop Vac Model QL20TS vacuum cleaner as manufactured by Shop Vac Corporation of Williamsport, Pa. The lid 44 makes up the bottom of the upper vacuum assembly 34 and carries one or more latches 52. The motor housing 46 is connected to the top of the lid 44. The cover 48, in turn, is connected to the top of the motor housing 46, and finally, the handle 50 sits atop the cover 48. When a user wishes to connect the upper vacuum assembly 34 to the tank 32, the user lifts the upper vacuum assembly 34 above the tank 32, aligns the latches 52 with the latch recesses 42, lowers the upper vacuum assembly 34 until the lid 44 rests on top of the tank 32, and then, fastens the latches 52 to the tank 32.

The motor housing 46 defines a pair of blower air discharge slots 54. Air drawn into the vacuum cleaner 30 by the inlet 40 is expelled through the blower air discharge slots 54 as shown by the arrow BA in FIG. 1. Also, the motor housing 46 has a pump outlet 56 and a three position ball valve 58 extending therefrom. The cover 48 of the upper vacuum assembly 34 provides a housing for a switch actuation assembly 60 (FIG. 3), described in detail below, which includes a user engageable actuator 62 (FIG. 2), and extending outward from the cover 48 is an electric cord 64. The electric cord 64 passes through a relief 65 in the cover 48 and may be permanently attached to the motor housing 46 or detachably connected thereto. The motor housing 46 and the cover 48 may be formed as two separate, detachable pieces or as one piece, integral with one another. With either construction, the motor housing 46 and the cover 48 define an air passage 66 which allows air to enter and exit the cover 48, as shown by the arrows CA in FIG. 1.

Figure 3:
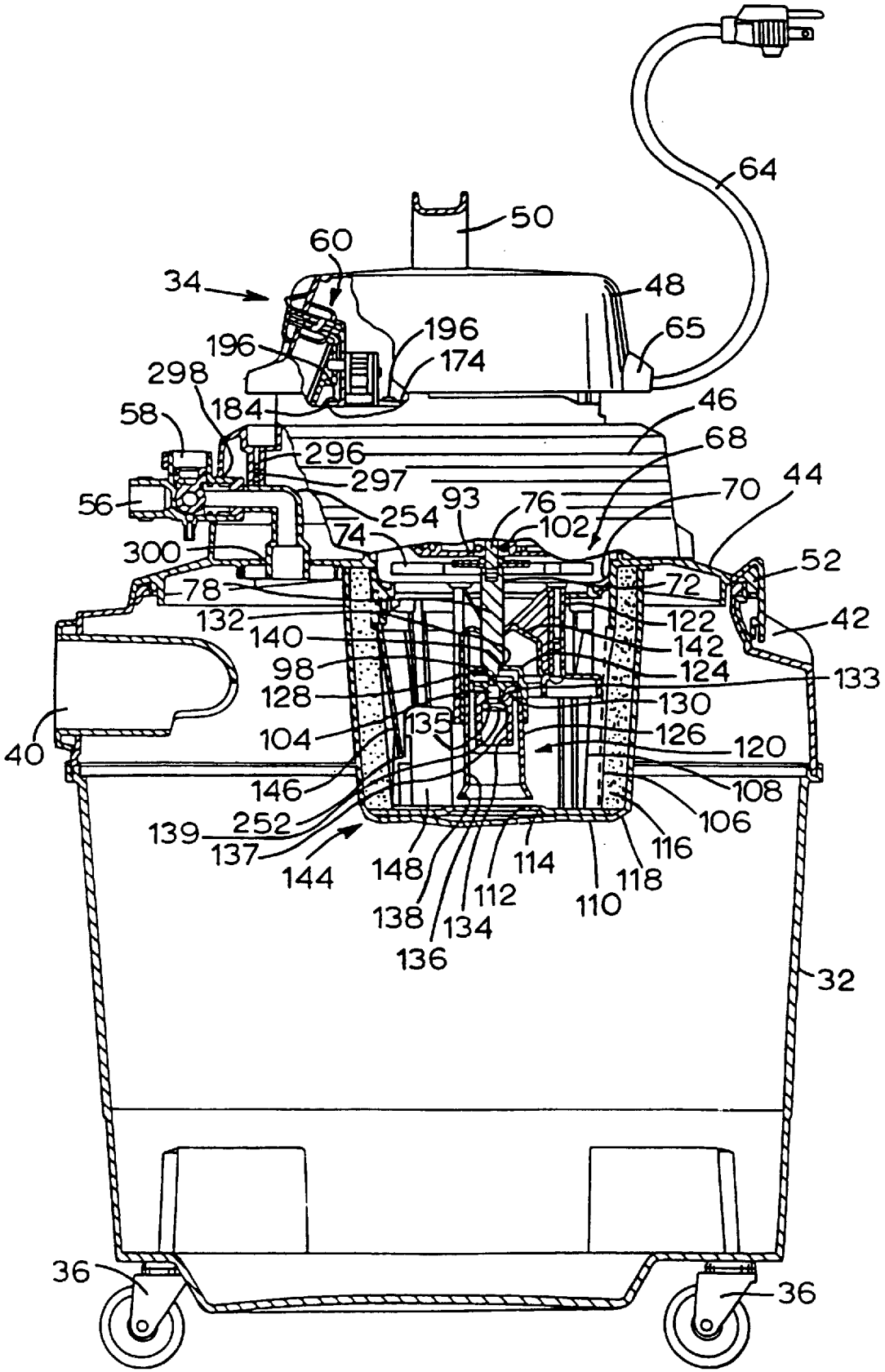
FIG. 3 is a side elevational view, partially in section along the line 3—3 in FIG. 2.
Figure 4:
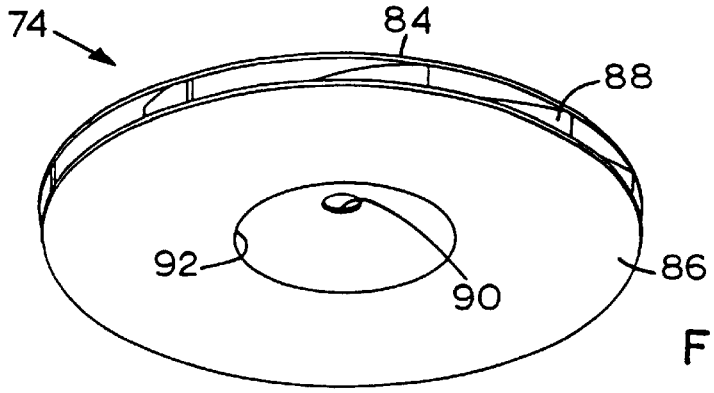
FIG. 4 is a perspective view of an air impeller of the present invention.
Figure 5:
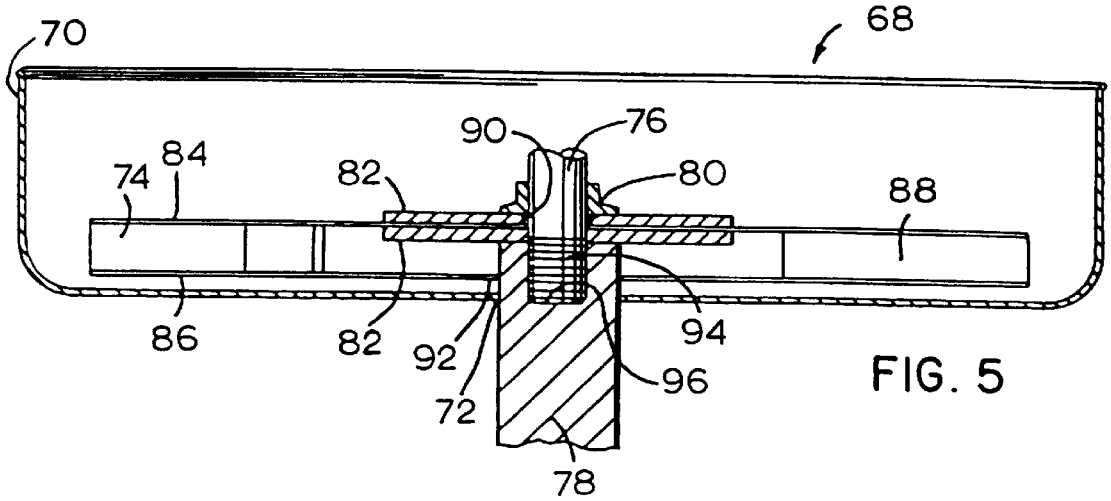
FIG. 5 is a partial view, partially in section, showing an air impeller assembly of the present invention.

Referring now to FIGS. 3–5, disposed in the upper vacuum assembly 34, among other things, is an air impeller assembly 68. The air impeller assembly 68 includes a housing 70 defining an opening 72, an air impeller 74, a motor shaft 76, a shaft extension 78, a flanged washer 80, and a pair of flat washers 82 (FIG. 5). (If desired, the vacuum cleaner 30 may alternatively use multiple air impellers.) The air impeller 74 has an upper plate 84 and a lower plate 86 with a series of blades 88 disposed between the upper and lower plates 84,86 (FIG. 4). The upper plate 84 defines a first opening 90, and the lower plate 86 defines a second opening 92 having a diameter larger than that of the first opening 90. The motor shaft 76 is connected to a motor 93 at one end (FIG. 3 —depicting a lower portion of the motor 93) and is threaded at the other end 94 (FIG. 5). The shaft extension 78 defines a threaded receptacle 96 and also has a threaded end 98 (FIG. 3).

The air impeller 74 is disposed within the housing 70 (FIG. 5). The threaded end 94 of the motor shaft 76 extends through the first opening 90 of the air impeller 74. The shaft extension 78 is secured to the motor shaft 76 by the engagement of the threaded end 94 of the motor shaft 76 with the threaded receptacle 96 of the shaft extension 78. Disposed between the upper plate 84 and the shaft extension 78 is one of the flat washers 82. The other flat washer 82 and the flanged washer 80 encircle the motor shaft 76 and are disposed between the upper plate 84 and a motor bearing 102 (FIG. 3). From the motor shaft 76, the shaft extension 78 extends through the second opening 92 of the air impeller 74, out through the opening 72 of the housing 70, and connects to a pump impeller 104 by way of the shaft extension threaded end 98 (FIG. 3). As such, the motor 93 supports the air impeller 74 and the pump impeller 104 and drives both via the motor shaft 76 and the shaft extension 78. Alternatively, the shaft extension 78 may be formed integral with the motor shaft 76 so that a unitary structure drives the air impeller 74 and the pump impeller 104. Another alternative is for the shaft extension 78 to be offset from the motor shaft 76, and torque is then transferred from the motor shaft 76 to the shaft extension 78 via a transmission or a gear train.

Referring to FIG. 3, the upper vacuum assembly 34 also includes a lid cage 106 which is integrally formed with the lid 44 and extends downward therefrom. The air impeller assembly 68 is disposed within the lid cage 106, and the air impeller 74 draws air through the lid cage 106. The lid cage 106 includes several braces 108 that support a bottom plate 110, and the bottom plate 110 defines a first oblong opening 112 and a second larger opening 114. A foam filter 116 surrounds the circumference of the lid cage 106, and a cloth filter 118 may be placed around the lid cage 106 during dry use of the vacuum cleaner 30 to keep dust from entering the opening 114. Instead of using a separate foam filter 116 and cloth filter 118, an alternative would be to use a unitary cartridge filter that would be easily replaceable.

Also included within the lid cage 106 is an upper pump assembly indicated generally at 120. A pump mount 122 attaches the upper pump assembly 120 to the air impeller housing 70. The upper pump assembly 120 includes the pump impeller 104, an upper impeller housing 124, and a lower impeller housing 126. The pump impeller 104 is made of nylon 6, and the upper and lower impeller housings 124, 126 are preferably made from acrylonitrile-butadiene styrene copolymer ("ABS"). The pump impeller 104 has a threaded receptacle 128 and a series of blades 130; the upper impeller housing 124 defines an opening 132; and the lower impeller housing 126 includes an inner annular wall 134 and an outer annular wall 136. The outer annular wall 136 flares out to create a flared portion 138. The lower impeller housing 126 is attached to the upper impeller housing 124, and in this embodiment, the two are threaded together. The threaded end 98 of the shaft extension 78 extends through the opening 132 in the upper impeller housing 124 and is in engagement with the threaded receptacle 128 of the pump impeller 104. As a result, the pump impeller 104 is suspended between the upper impeller housing 124 and the lower impeller housing 126, allowing the pump impeller 104 to rotate freely. The diameter of the shaft extension 78 and the diameter of the opening 132 are sized such that an annular gap 140 having a diametral clearance on the order of 0.030 inches is created between them. The clearance in the gap 140 may fluctuate +/−0.015 inches due to the tolerances allowed in the manufacture of the shaft extension 78 and the opening 132. The gap 140 is intentionally unsealed so that fluid is permitted to freely flow from inside the upper impeller housing 124 to outside the upper impeller housing 124. With the gap 140, there is no contact between the shaft extension 78 and the upper impeller housing 124. The lack of contact between the two prevents the generation of frictional heat and, therefore, reduces the need for cooling at the gap 140. Further significance of the gap 140 is explained in detail below. A deflector 142, formed integrally with the pump mount 122, is used to keep any liquid which splashes up through the gap 140 from entering the air impeller assembly 68.

The upper vacuum assembly 34 also houses a mechanical shut-off and override assembly indicated generally at 144. The mechanical shut-off and override assembly 144 includes the switch actuation assembly 60, a float rod 146 and a float 148. The switch actuation assembly 60 is located in the cover 48, and the float 148 rests on the bottom plate 110 of the lid cage 106 with the float rod 146 passing through the lid 44 and the motor housing 46, providing a linkage between the switch actuation assembly 60 and the float 148.

Figure 6:
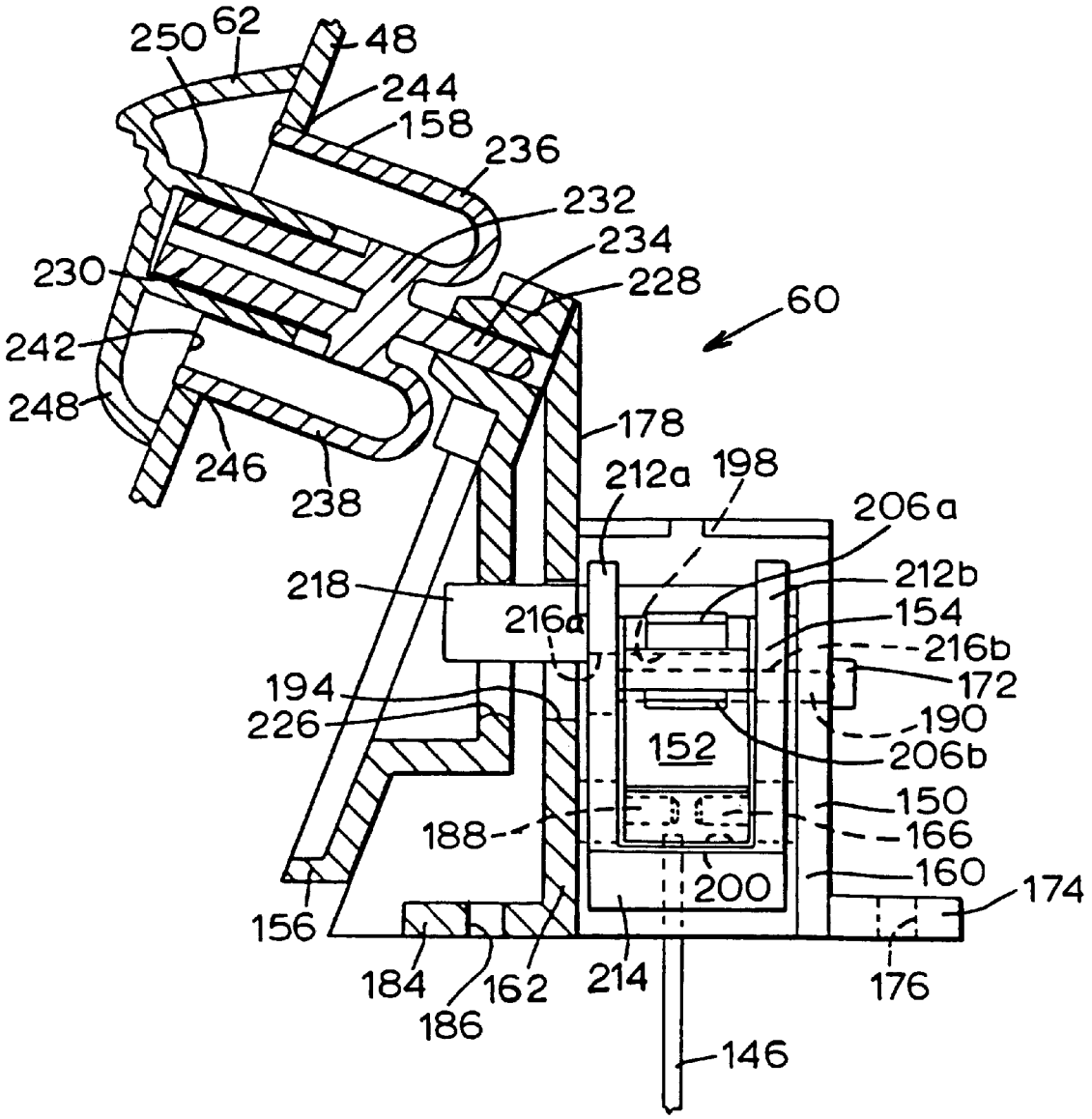
FIG. 6 is a partial side view, partially in section and partially in phantom, showing a switch actuation assembly of the present invention.
Figure 7:
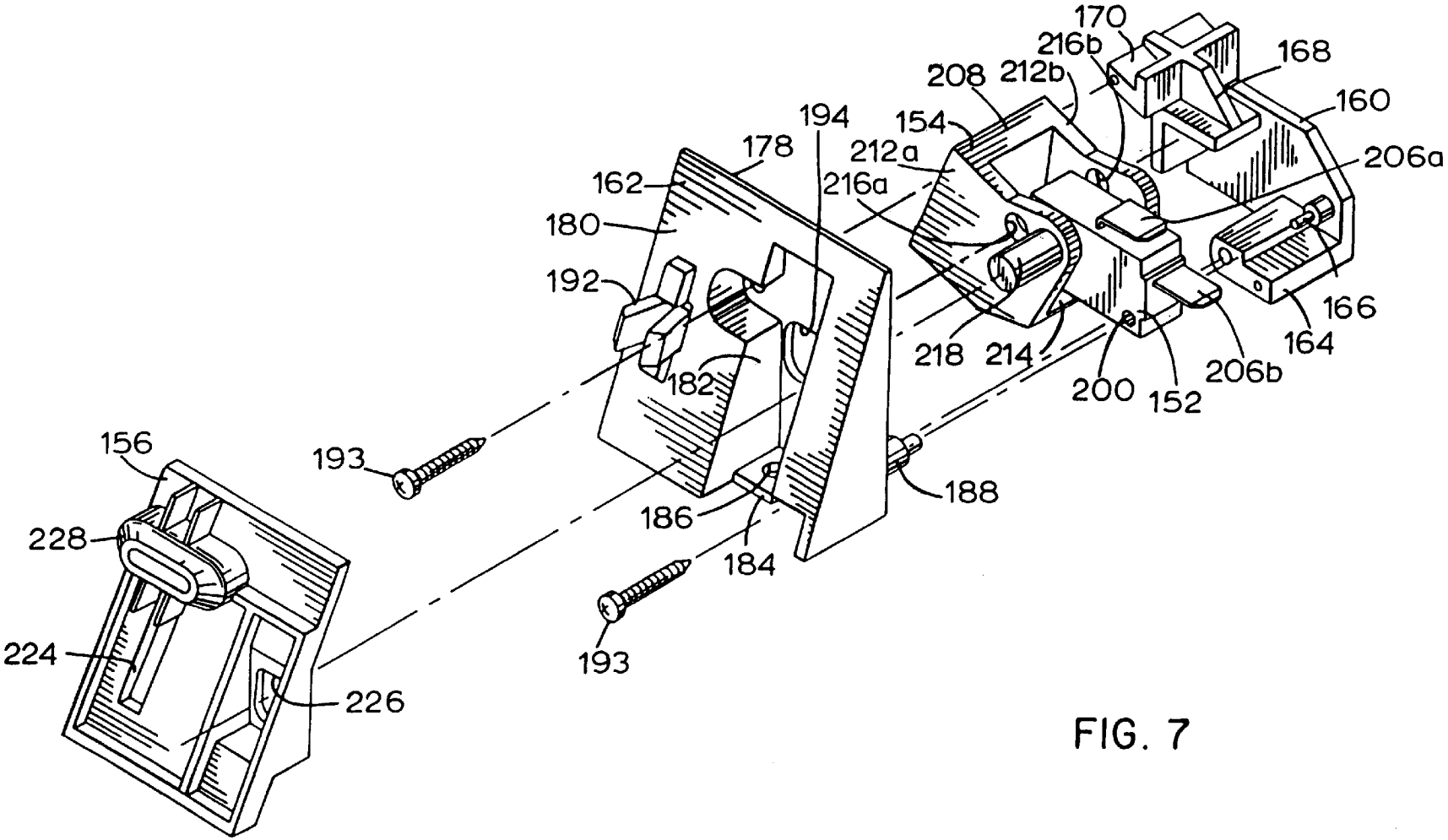
FIG. 7 is an exploded perspective view of a portion of the switch actuation assembly.

Referring to FIGS. 6–9B, the switch actuation assembly 60 is shown in greater detail. It should be understood that FIG. 6 (as well as FIGS. 19B–25B) does not depict a true sectional view of the switch actuation assembly 60; rather, FIG. 6 is an illustration of the switch actuation assembly 60 composed to assist in explaining the interrelation of the switch actuation assembly elements. The precise alignment of some of the components of the switch actuation assembly 60 are shown in the exploded view of FIG. 7. The switch actuation assembly 60 includes a switch mount 150 (FIG. 6), a switch 152, a toggle 154, a link 156 (FIG. 6), a spring member 158 (FIG. 6) and the user engageable actuator 62 (FIG. 6). In the preferred embodiment, the switch mount 150, the toggle 154, and the link 156 are preferably made from ABS, the user engageable actuator 62 is preferably made from nylon 6/6, and the spring member 158 is preferably made from nylon. The switch mount 150 is made from two parts: a switch box 160 and a switch cover 162 (FIG. 7). Extending inward from and integrally formed with the switch box 160 is a switch box spacer 164, a first switch support rod 166, and a toggle spacer 168 including a toggle stop 170. Extending outward from the switch box 160 is an axle receptacle 172 and a connection flange 174 which defines a bolt hole 176 (FIG. 6). The switch cover 162 is wedge shaped and has an inner wall 178 and an inclined outer wall 180 (FIG. 7). Cut into the outer wall 180 is a slot 182. The bottom of the slot 182 is defined by a connection flange 184, which also defines a bolt hole 186. Extending inward from and integrally formed with the switch cover inner wall 178 is a second switch support rod 188 and a toggle axle 190 (FIG. 6). The end of the toggle axle 190 seats in the axle receptacle 172 of the switch box 160. Extending outward from and integrally formed with the switch cover outer wall 180 is a link fastener 192. The switch cover 162 further defines an opening 194 which communicates with the slot 182. The switch cover 162 is connected to the switch box 160 by a pair of screws 193 to form the switch mount 150. The switch mount 150, in turn, is secured to the motor housing 46 by a pair of bolts 196 which extend through the connection flanges 174, 184 and into the motor housing 46 (FIG. 3).

Figure 8:
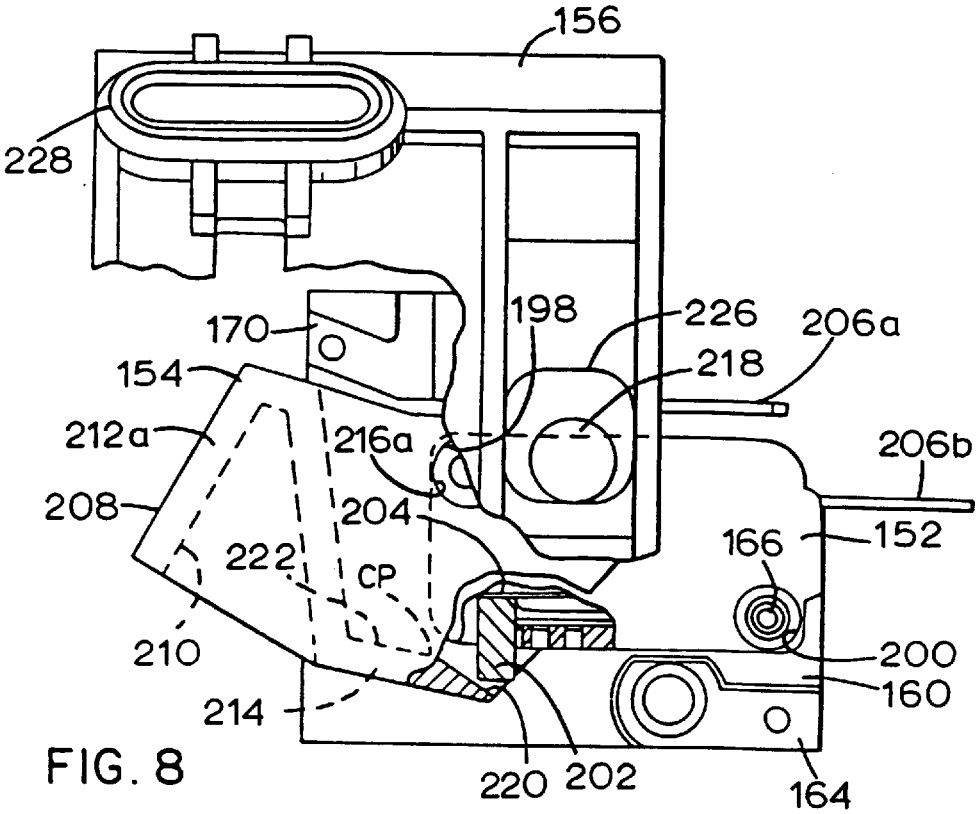
FIG. 8 is a partial front view, partially broken away and partially in phantom, of the switch actuation assembly.

Referring to FIG. 8, the switch 152 is a standard electrical microswitch and includes an axle bore 198, a support bore 200, a momentary actuator 202, an internal spring 204, and a pair of electrical terminals 206*a*, 206*b*. The switch 152 is of the type that the switch is normally in the "OFF" position and is "ON" only while the momentary actuator 202 is depressed. Once the actuator 202 is released, the internal spring 204 pushes the actuator 202 outward and returns the switch 152 to the normally "OFF" position. In the preferred embodiment, a Unimax Model #TMCJG6SP0040Y made by C&K/Unimax Inc. of Willingford, Conn., is used. The switch 152 is securely seated in the switch mount box 150, and is supported by the first and second switch support rods 166, 188, which are disposed in the support bore 200 (FIG. 6), and the toggle axle 190, which is disposed in the axle bore 198.

Figure 20A:
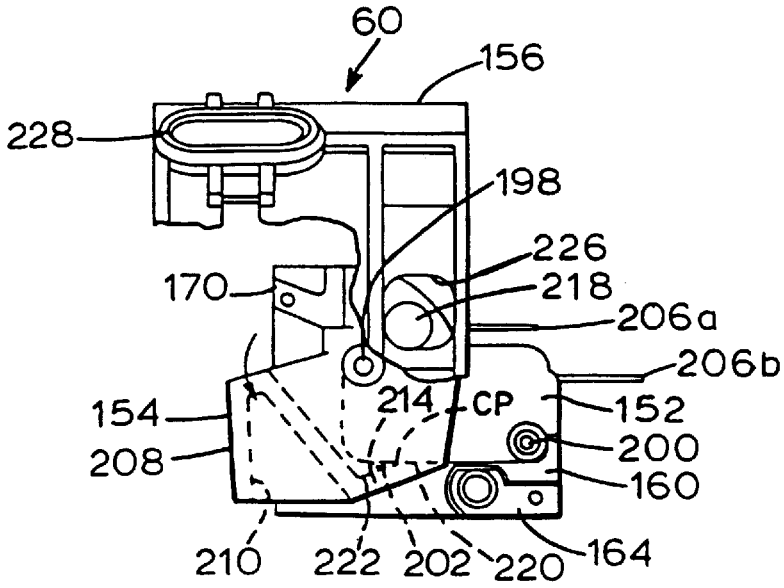
FIG. 20A is a partial front view, partially broken away and partially in phantom, showing the switch actuation assembly transitioning from the "OFF" to the "ON" position.

Referring to FIGS. 7 and 8, the toggle 154 is generally U-shaped and includes a back wall 208 which defines a rod receiving extension 210 (FIG. 8) for receiving the float rod 146 (FIG. 6), a pair of sidewalls 212*a*, 212*b*, and a locking brace 214 spanning between the sidewalls 212*a*, 212*b*. Both sidewalls 212*a*, 212*b* define an axle opening 216*a*, 216*b*, and a boss 218 extends outward from one sidewall 212*a* (FIG. 7). The toggle 154 is disposed in the switch mount 150 with the pair of sidewalls 212*a*, 212*b* disposed on opposite sides of the switch 152, the sidewall 212*b* spaced away from the switch box 160 by the toggle spacer 168, and the locking brace 214 disposed beneath the switch 152 (FIG. 6). As such, the toggle axle 190 extends through the axle openings 216*a*, 216*b*, and the boss 218 extends through the opening 194 in the switch cover 162 (FIG. 6). As seen specifically in FIG. 8, the locking brace 214 includes a ramp portion 220 and a locking portion 222 with the locking portion 222 intersecting the ramp portion 220 at a critical point CP. In the preferred embodiment, the included angle between the ramp portion 220 and the locking portion 222 is approximately 158 degrees, although this dimension may vary from such value, as will be apparent to one of ordinary skill in the art. The angle between the ramp portion 220 and the locking portion 222 is such that when the toggle 154 is fully rotated counter-clockwise, as seen in FIG. 20A, the ramp portion 220 lies flush against the bottom surface of the switch 152.

Referring to FIGS. 6–9B, the link 156 defines an elongated slot 224 and a boss slot 226, and extending outward from the link 156 is a spring member receptacle 228. The link fastener 192 is disposed in the elongated slot 224, and connects the link 156 to the switch mount 150. The elongation of the slot 224 allows the link 156 to slide up and down in relation to the switch mount 150. Also, the boss 218 of the toggle 154 extends through the boss slot 226 (FIG. 6).

Figure 9A:
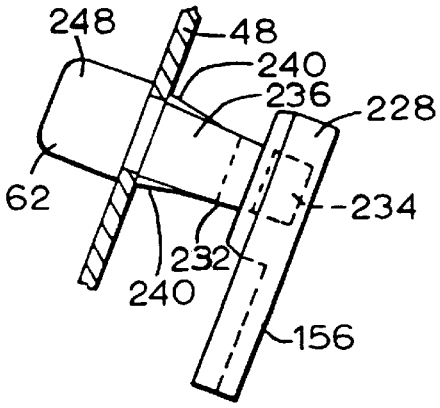
FIG. 9A is a partial top plan view, partially in phantom, of the switch actuation assembly.
Figure 9B:
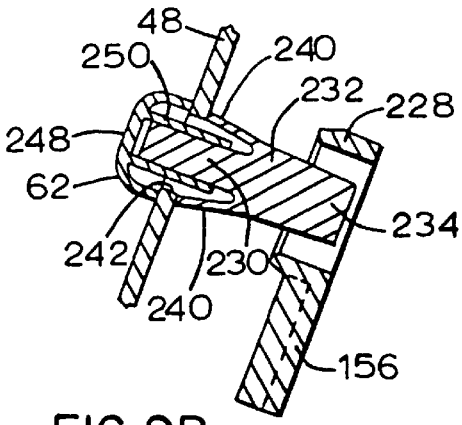
FIG. 9B is partial top plan view, in section and partially in phantom, of the switch actuation assembly.

Referring to FIGS. 6, 9A, and 9B, the spring member 158 includes an actuator stem 230, a linkage web 232, a tongue 234, an upper spring 236, a lower spring 238, and a pair of siderails 240 (FIG. 9). The linkage web 232 connects the actuator stem 230, the tongue 234, the upper spring 236, the lower spring 238, and the siderails 240 together. The upper spring 236 and the lower spring 238 both curve outward from the linkage web 232 and backward from the tongue 234 toward the end of the actuator stem 230 (FIG. 6). The upper and lower springs 236, 238 are both disposed in a slot 242 formed in the cover 48 with the actuator stem 230 extending through the slot 242. The upper spring 236 engages a top lip 244 of the slot 242 creating a first load, while the lower spring 238 engages a bottom lip 246 of the slot 242 creating a second load. In the preferred embodiment, the first load and the second load are equally balanced, centering the user engageable actuator 62 in the slot 242 when the user engageable actuator 62 is not engaged. On the other end, the tongue 234 is disposed in the spring member receptacle 228 (FIG. 6). The user engageable actuator 62 includes an engageable portion 248 coupled to a hollow stem coupler 250. The hollow stem coupler 250 extends inwardly through the cover slot 242 and is disposed around the actuator stem 230 of the spring member 158. The engageable portion 248 of the user engageable actuator 62 is disposed on the outside of the cover 48, and the siderails 240 engage the inside of the cover 48 creating a snug fit between the spring member 158 and the cover 48 (FIG. 9).

Referring again to FIG. 3, the float 148 is hollow and may be made of any suitable material, such as copolymer polypropylene. The float 148 defines a rod receptacle 252 in which the float rod 146 sits. The float rod 146 moves in an unrestricted, non-contained linear up-and-down path in the preferred embodiment. However, other embodiments are envisioned in which the float rod 146 would travel in a linear up-and-down path in a contained channel or guidance slot.

Figure 10:
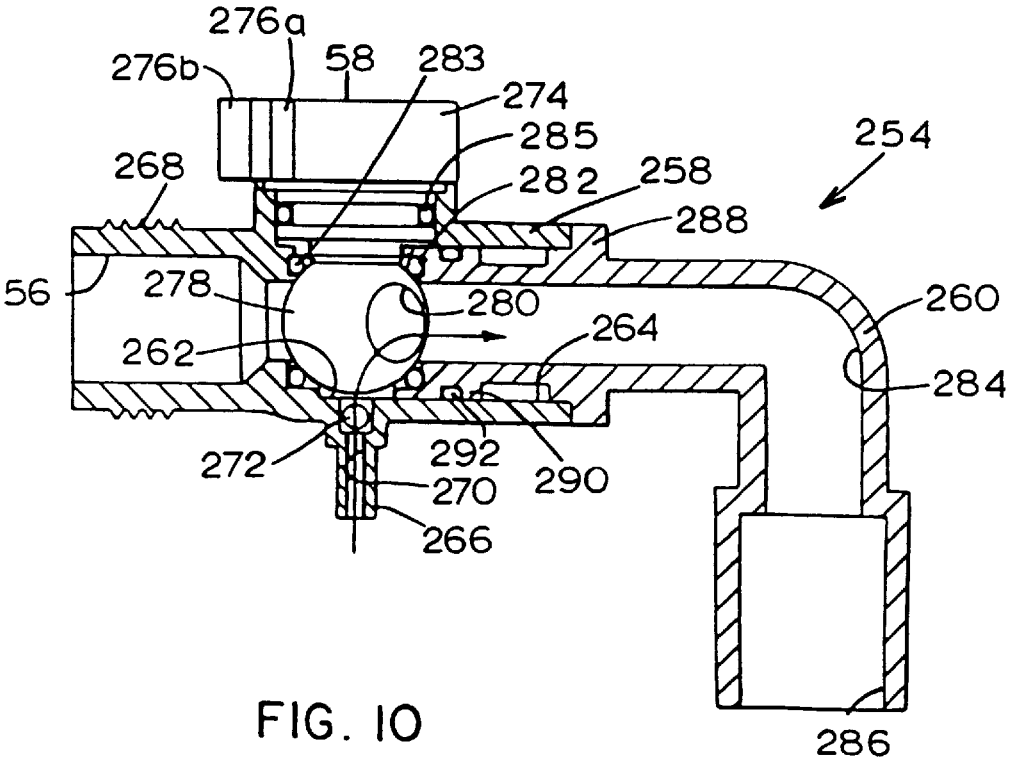
FIG. 10 is a partial view, partially in section, showing a first half of an outlet section of the present invention.
Figure 11:
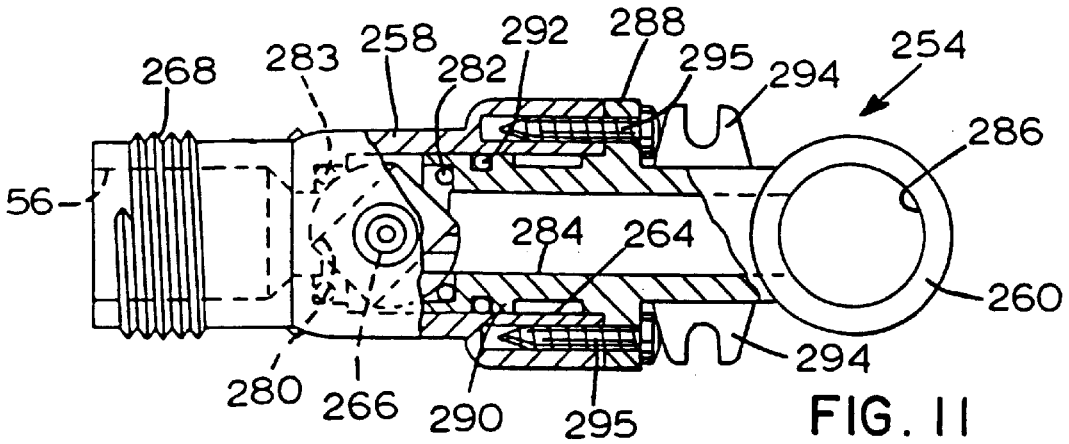
FIG. 11 is a bottom view, partially broken away and partially in phantom of a ball valve in the position of FIG. 10.
Figure 16:
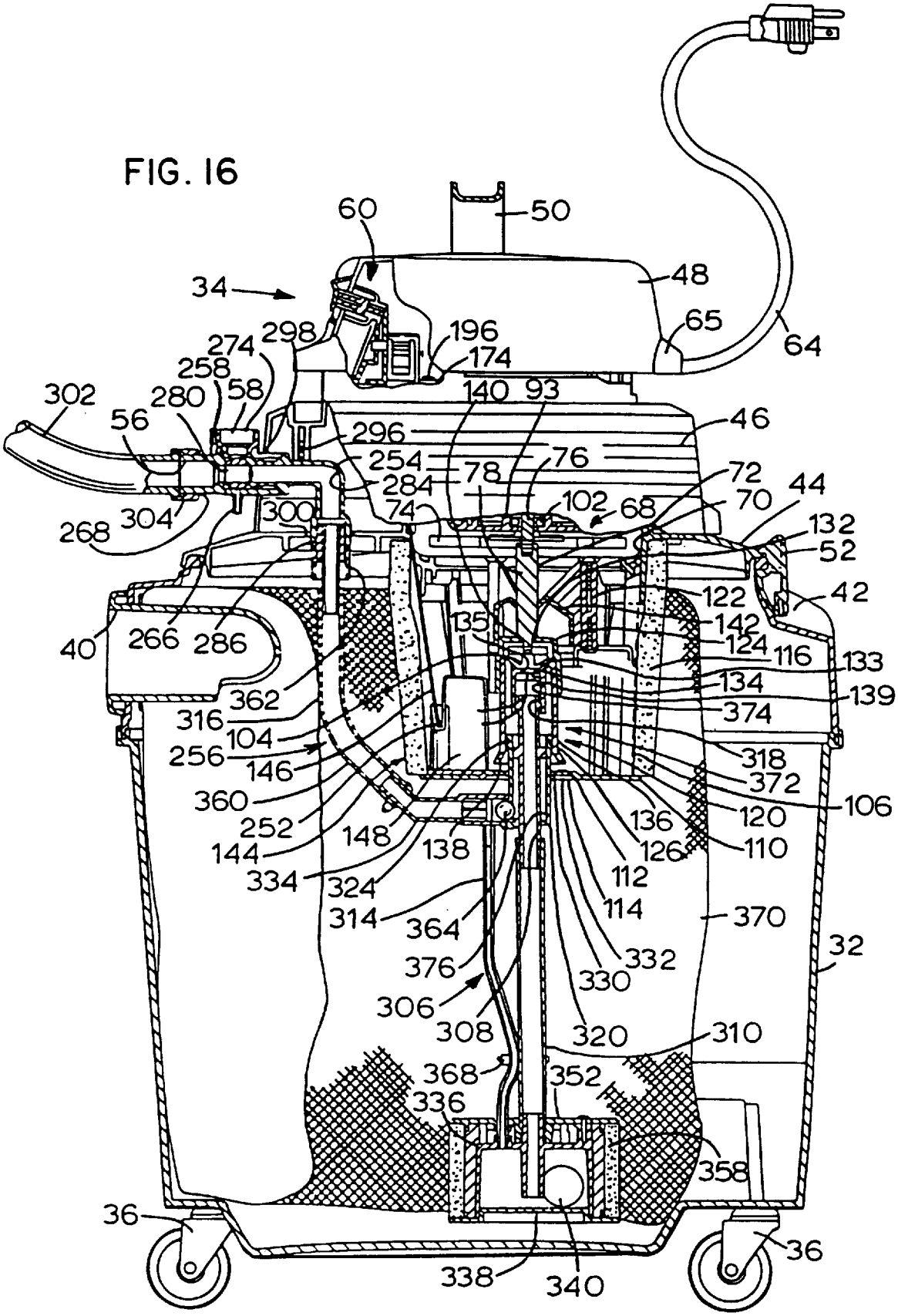
FIG. 16 is a view similar to FIG. 3 with a collection bag and the pump adapter assembly installed and a hose attached.

Referring to FIG. 3, the upper vacuum assembly 34 also encloses a first half 254 of an outlet section 256 (FIG. 16). Referring to FIGS. 10 and 11, the first half 254 of the outlet section 256 includes a housing 258, the ball valve 58, and an elbow 260. The housing 258 defines the pump outlet 56, a ball seat 262, and an elbow cavity 264. The housing 258 further includes an inlet 266 extending downward from the housing 258 and a threaded portion 268 disposed around the exterior of the housing 258. The inlet 266 defines a bore 270 and has a check valve 272, which prevents air or liquid from the elbow 260 or the pump outlet 56 from escaping through the inlet 266. The ball valve 58 includes a knob 274 having three dogs 276*a*–*c* attached to a ball 278 having a passageway 280 bored therethrough for opening and closing the valve 58. The knob 274 is disposed outside the housing 258 while the ball 278 is seated in the ball seat 262 of the housing 258. A pair of O-rings 282, 283 situated between the ball 278 and the housing 258 creates a seal between the ball 278 and the housing 258. Similarly, an O-ring 285 situated between the knob 274 and the housing 258 creates a seal between the knob 274 and the housing 258. The elbow 260 defines a passageway 284 and an adapter receptacle 286. Extending outward from and integral with the elbow 260 are a housing closure 288, a sealing flange 290 having an O-ring 292, and a pair of connectors 294 (FIG. 11). The elbow 260 is secured in the elbow cavity 264 of the housing 258 with screws 295 (FIG. 11) such that the elbow 260 abuts the O-ring 282 forming a seal with the ball 278 and putting the passageway 284 in communication with the ball 278. Also, the O-ring 292 forms a seal between the elbow 260 and the housing 258, and the housing closure 288 caps off the housing 258. The first half 254 of the outlet section 256 is secured within the motor housing 46 by screwing a pair of screws 297 through the connectors 294 and into a pair of bosses 296 in the motor housing 46 (FIG. 3). The housing 258 extends through an opening 298 in the motor housing 46, and the adapter receptacle 286 extends through an opening 300 in the lid 44 (FIG. 3). A hose 302 may be connected to the housing 258 by securing a connector 304 to the threaded portion 268 of the housing 258 (FIG. 16). The connector 304 may be of a threaded ring type found on the ends of garden hoses.

Figure 12A:
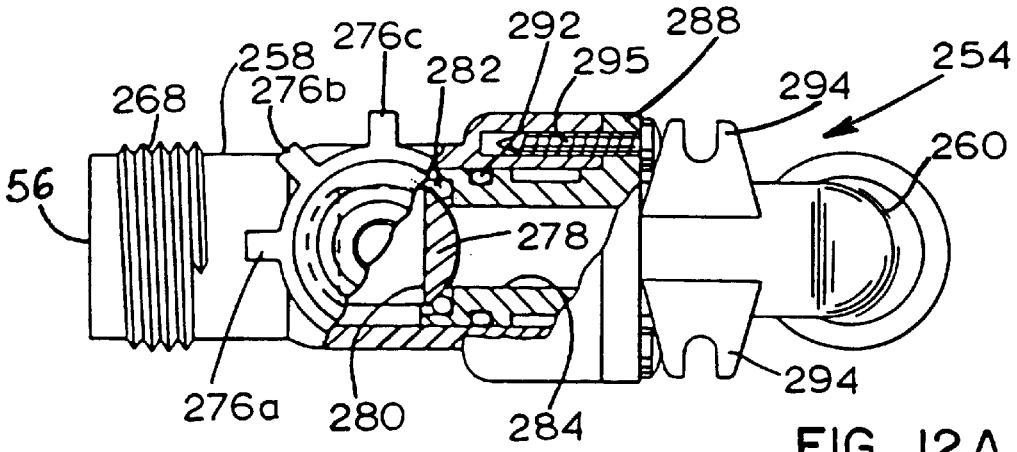
FIG. 12A is a partially broken away top view of the ball valve of FIG. 3 with the ball valve in the closed position.

The dogs 276*a*–*c* of the knob 274 serve to indicate the angular position of the passageway 280 inside the housing 258. As illustrated in FIG. 12A, the dog 276*a* is aligned with the pump outlet 56, and the ball 278 prevents fluid from flowing from the elbow 260 to the pump outlet 56 or vice versa. Fluid is prevented from flowing past the ball in this position because the passageway 280 is perpendicular to the passageway 284, and the ball 278 forms a seal with the housing 258.

Figure 12B:
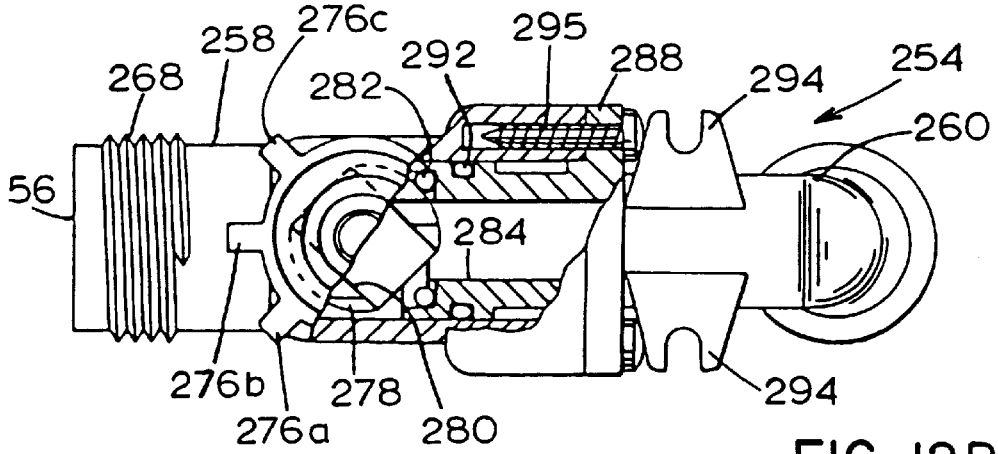
FIG. 12B is a top view similar to that of FIG. 12A with the ball valve in the partially open position.

When the dog 276*b* is aligned with the pump outlet 56, as illustrated in FIG. 12B, the passageway 280 is at a 45° angle to the passageway 284, permitting only partial fluid flow from the elbow 260 to the pump outlet 56. Also, as seen in FIG. 10, when the ball 278 is in this position, the check valve 272 allows air in through the inlet 266 and into the elbow 260. The ball 278 in FIG. 10 has not been sectioned so that the path air may travel through the inlet 266 to the elbow 260 may be seen more clearly. The arrows in FIGS. 10 and 11 each show the path air takes after entering through the inlet 266. After entering through the inlet. 266, air passes through the check valve 272 and then proceeds around the outside of the ball 278, across the passageway 280, and into the passageway 284. Air may pass by the ball 278 in this position because opposing end sections of the ball 278 have been removed in creating the passage 280. As such, in this position, the ball 278 does not create a complete seal with the housing 258.

Figure 12C:
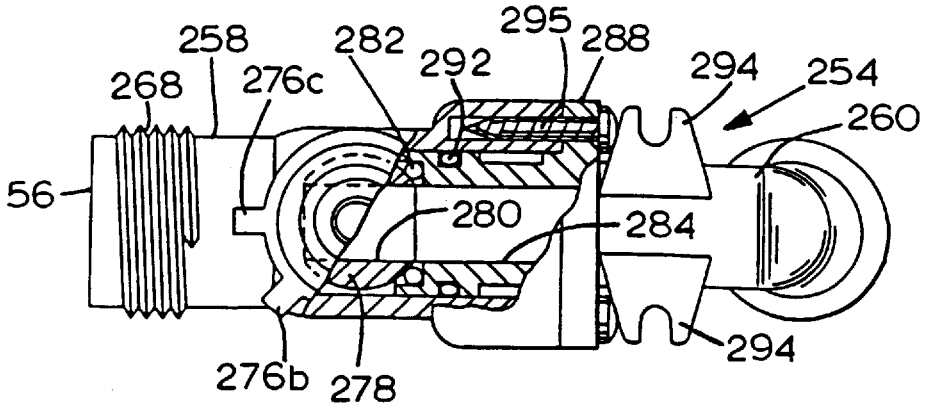
FIG. 12C is a top view similar to FIGS. 12A and B showing the ball valve in the open position.

When the dog 276*c* is aligned with the pump outlet 56, as illustrated in FIG. 12C, the passageway 280 is aligned with the passageway 284, permitting full fluid flow from the elbow 260 to the pump outlet 56.

Figure 13:
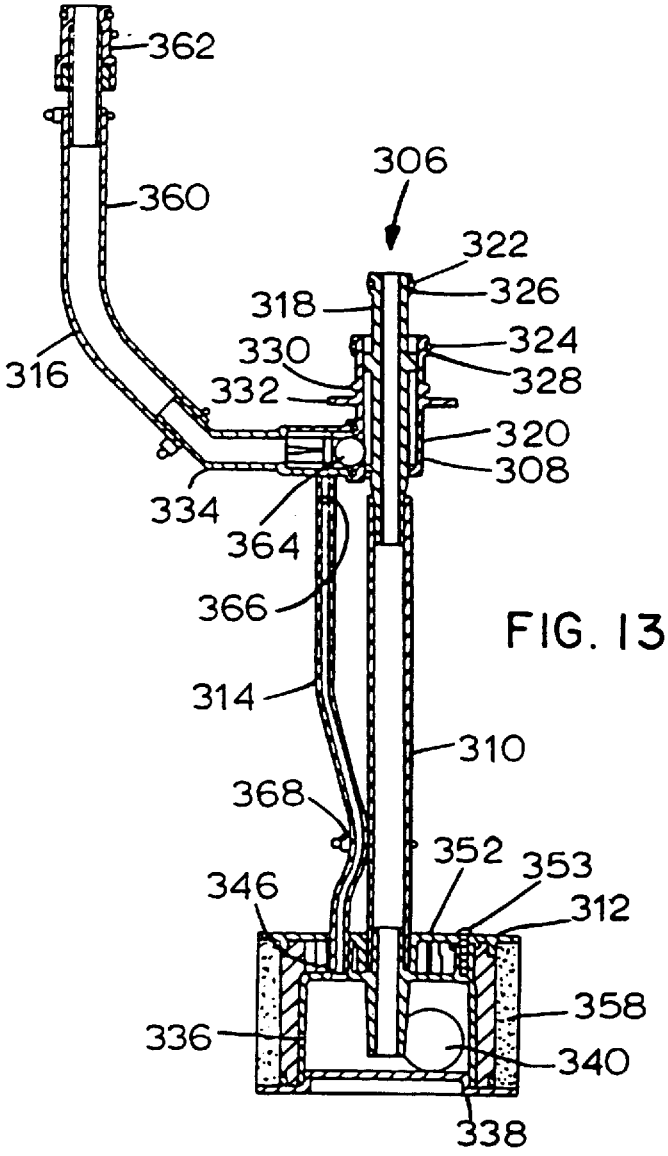
FIG. 13 is a side elevational view, in section, of a pump adapter assembly of the present invention.

FIG. 13 depicts a pump adapter assembly 306 which includes a pump fitting 308, a lower inlet tube 310, a pressure differential apparatus 312, a conduit 314, and a second half 316 of the outlet section 256. The pump fitting 308, which is preferably made from ABS, includes an upper inlet tube 318 and an outer annular wall 320 that encircles the bottom half of the upper inlet tube 318 and is formed integrally therewith. Both the upper inlet tube 318 and the outer annular wall 320 have an O-ring 322, 324 disposed in respective grooves 326, 328 formed in each one's upper ends. At the end opposite the O-ring 322, the upper inlet tube 318 inserts into the lower inlet tube 310. Extending outward from the outer annular wall 320 is a pair of flanges 330, 332. The upper flange 330 is oblong in shape, and the lower flange 332 is radial with the greatest diameter of the upper flange 330 being smaller than the diameter of the lower flange 332. The outer annular wall 320 is also attached to and in fluid communication with a pump connector 334 of the second half 316 of the outlet section 256.

Figure 14:
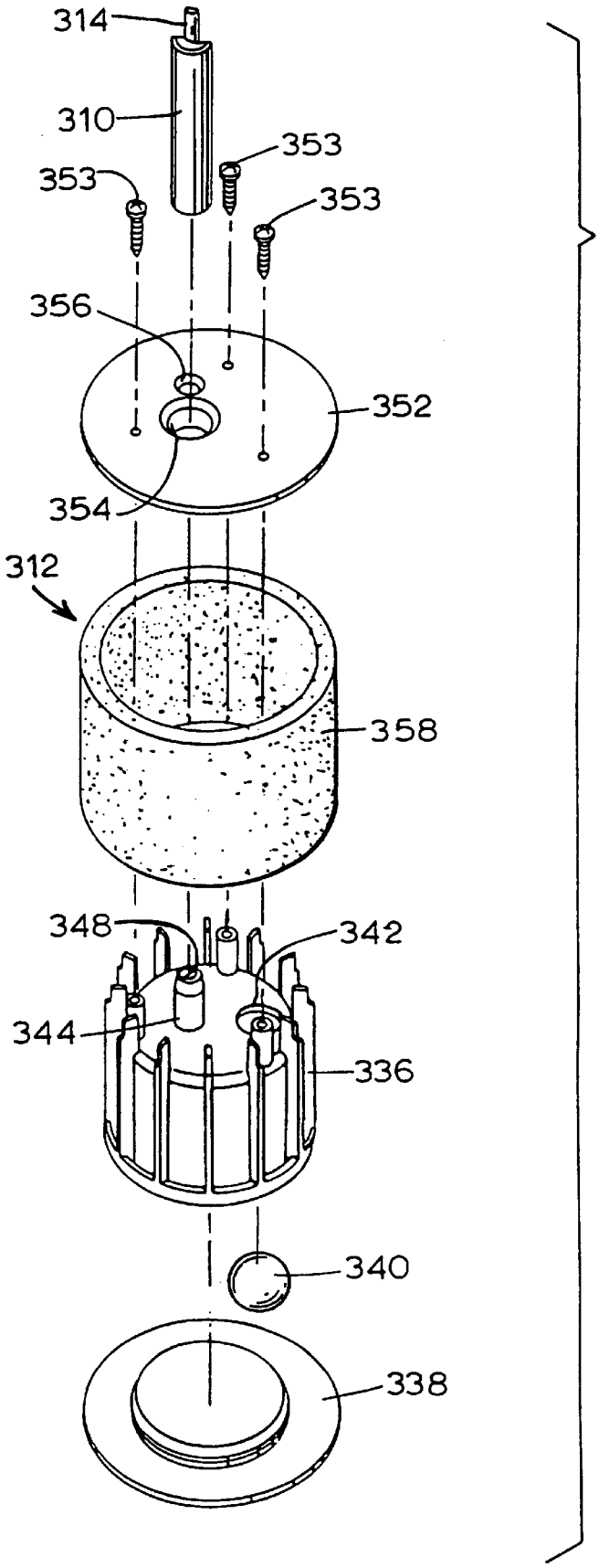
FIG. 14 is a exploded view of a pressure differential apparatus of the pump adapter assembly of FIG. 13.
Figure 15A:
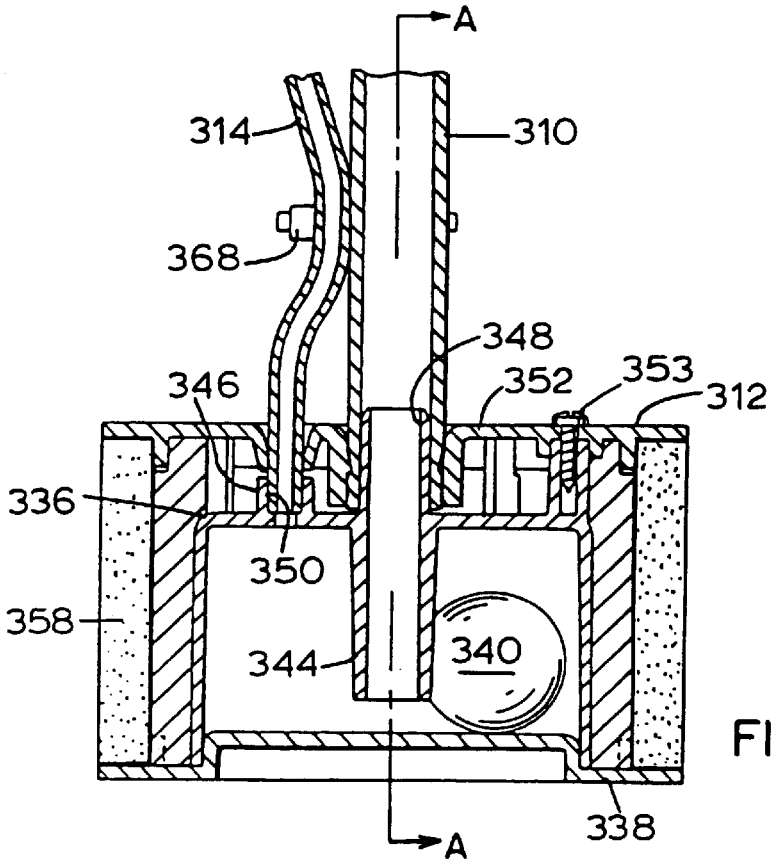
FIG. 15A is an enlarged view of the pressure differential apparatus of FIG. 13.
Figure 15B:
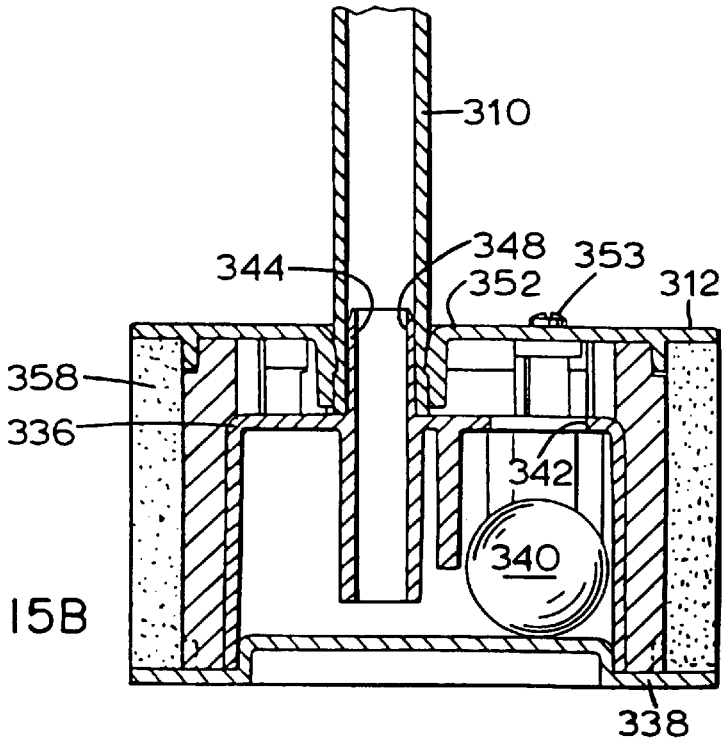
FIG. 15B is a cross-section taken along the line A—A of FIG. 15A of the pressure differential apparatus.
Figure 15C:
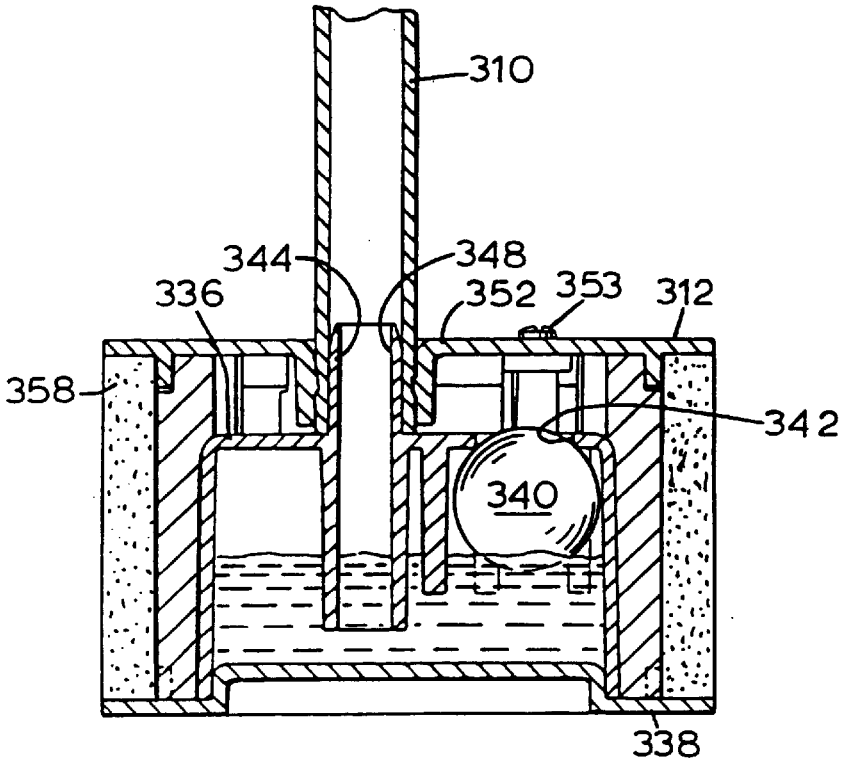
FIG. 15C is a sectional view similar to FIG. 15B showing the pressure differential apparatus partially filled with liquid.

As best seen in FIGS. 14, 15A, 15B, and 15C, the pressure differential apparatus 312 includes a hollow body 336 closed by a bottom plate 338 to form a cavity for a ball 340. The hollow body 336 includes an opening 342 in which the ball 340 may seat (FIG. 15C). The hollow body 336 also has upward extending fittings 344, 346 (FIG. 15A), which define openings 348, 350 (FIG. 15A), for attaching, respectively, the lower inlet tube 310 and the conduit 314. A top plate 352 is attached to the hollow body 336 by screws 353. As best seen in FIG. 14, the top plate 352 has openings 354, 356 through which the inlet tube 310 and the conduit 314 respectively pass. The top plate 352 and the bottom plate 338 enclose a filter 358 ensuring that any liquid passing into the hollow body 336 through the opening 342 also passes through the filter 358.

Returning now to FIG. 13, the second half 316 of the outlet section 256 includes the pump connector 334, a flexible tube 360, and a rotatable connector 362. The pump connector 334 attaches to the outer annular wall 320 of the pump fitting 308 at one end, as described above, and attaches to the flexible tube 360 at the other end. The other end of the flexible tube 360 attaches to the rotatable connector 362. The pump connector 334 includes a check valve 364 and a conduit fitting 366. The check valve 364 permits flow from the pump fitting 308 into the pump connector 334, but the check valve 364 does not permit flow from the pump connector 334 into the pump fitting 308. The conduit 314, at one end, connects to the conduit fitting 366 of the pump connector 334. The conduit fitting 366 is disposed on the outlet side of the check valve 364 so that any fluid passing down through the flexible tube 360 can pass into the conduit 314 without being blocked by the check valve 364. The conduit 314, at the other end, fits into the fitting 346 in the hollow body 336. In between the two conduit ends, a clamp 368 holds the conduit 314 against the lower inlet tube 310.

The vacuum cleaner 30 may be operated in two modes: dry and wet vacuuming mode. FIG. 3 shows the vacuum cleaner 30 in dry mode configuration. The ball valve 58 is in a closed position to maintain the pressure differential in the tank 32, and the cloth filter 118 is in place around the lid cage 106 to keep dust from entering the opening 114. To convert the vacuum cleaner 30 to wet mode operation, the cloth filter 118 is removed, and the pump adapter assembly 306 is installed (FIG. 16). To install the pump adapter assembly 306 and create a pump indicated generally at 372, the user first inserts the pump fitting 308 through the openings 112, 114 in the lid cage bottom plate 110 and into the lower impeller housing 126 of the upper pump assembly 120. The flared portion 138 of the upper pump assembly 120 facilitates insertion of the pump adapter assembly 306 into the lower impeller housing 126. During insertion, the upper inlet tube 318 slides within the inner annular wall 134 of the lower impeller housing 126, and the O-ring 322 forms a seal with the inner annular wall 134. Similarly, the outer annular wall 320 of the pump fitting 308 slides within the outer annular wall 136 of the lower impeller housing 126, and the O-ring 324 forms a seal with the outer annular wall 136. Lastly, the radial flange 332 seats in the opening 114.

To secure the pump adapter assembly 306 to the lid cage 106, the user twists the pump adapter assembly 306 ninety degrees, causing the pump fitting 308 to also turn placing the oblong flange 330 in contact with the bottom plate 110 of the lid cage 106. To finish connecting the pump adapter assembly 306 to the upper vacuum assembly 34, the user manipulates the rotatable connector 362 and inserts the rotatable connector 362 into the adapter receptacle 286. The completed pump 372 includes a priming chamber 374 and a discharge recess 376. The priming chamber 374 is defined by the cooperation of the upper inlet tube 318, the O-ring 322, the inner annular wall 134, and the pump impeller 104. The discharge recess 376 is defined by the cooperation of the outer annular wall 136 of the lower impeller housing 126, the O-ring 324, and the outer annular wall 320 of the pump fitting 308. The dimension of each of the parts of the pump 372 will be dependent on the desired flow rate of the pump 372. In addition, the power of the motor 93 may also affect the size and design of many components, including the pump impeller 104.

Figure 17:
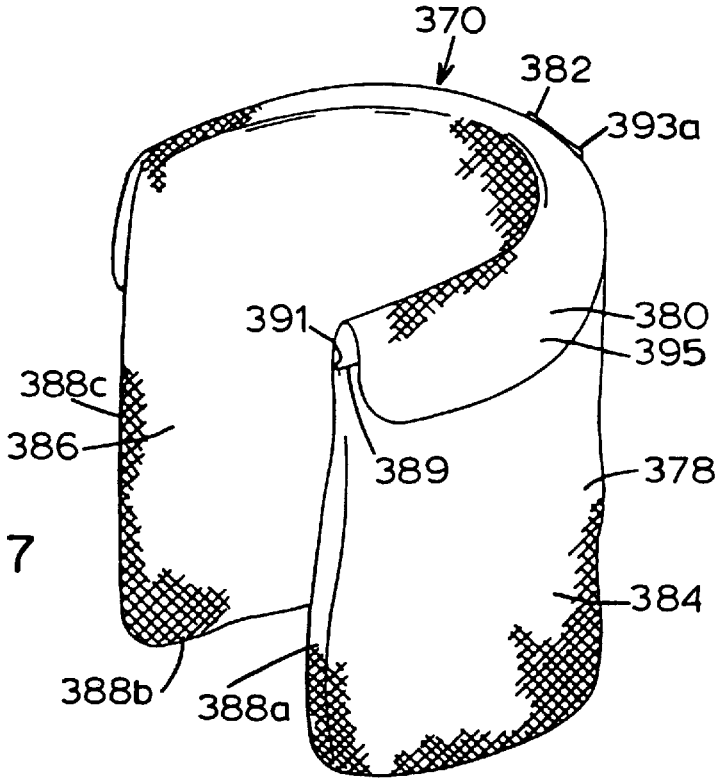
FIG. 17 is a perspective view of the collection bag of the present invention.
Figure 18A:
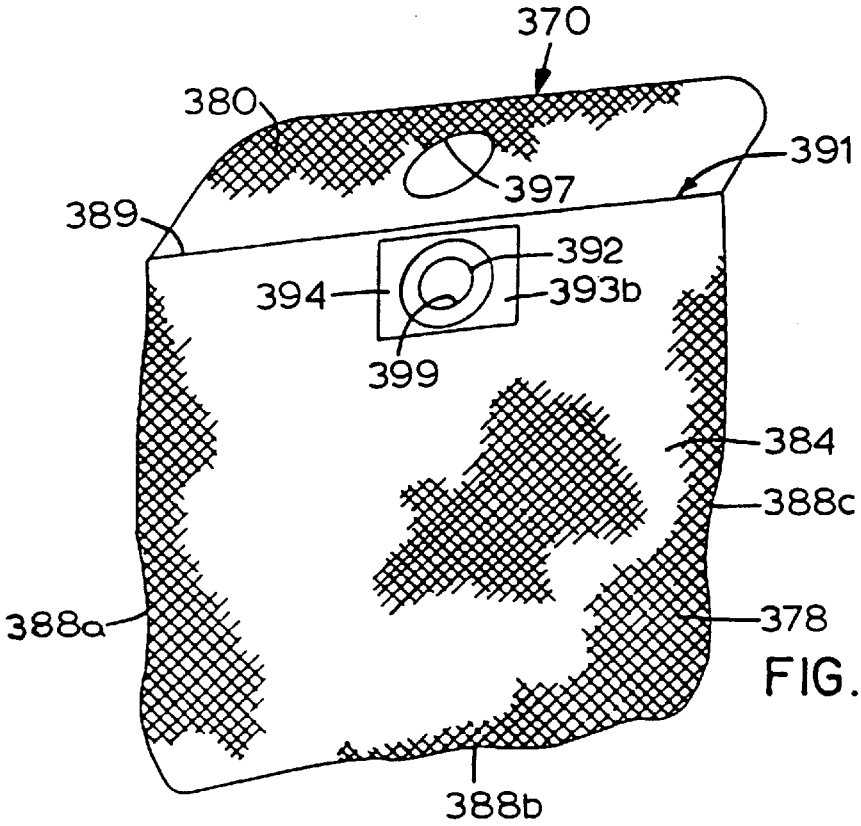
FIG. 18A is a perspective view of the collection bag with a closure flap in a open position.
Figure 18B:
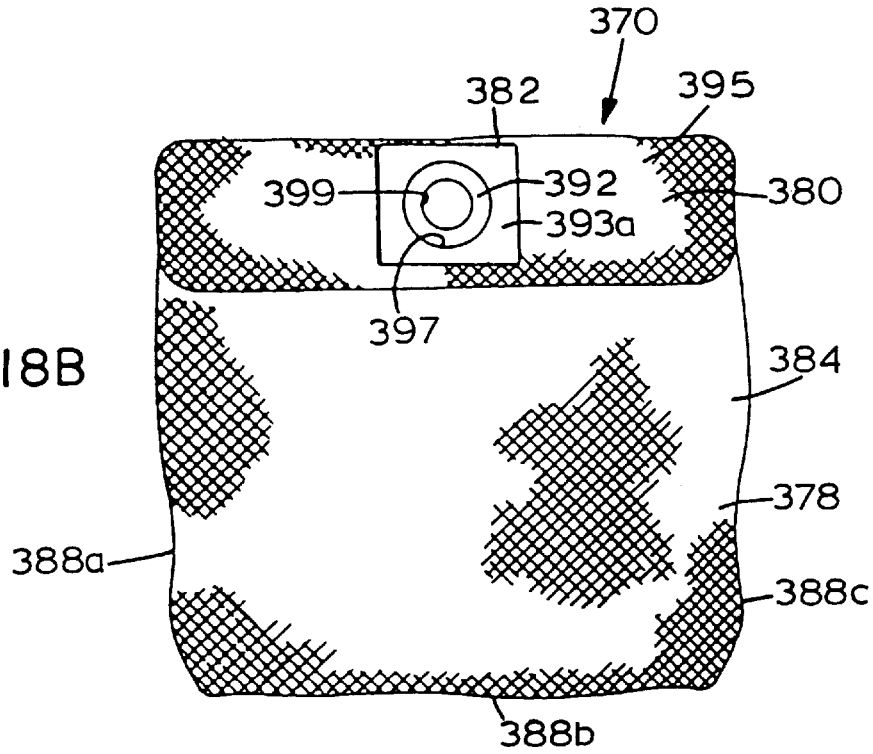
FIG. 18B is a front elevational view of the collection bag with the closure flap in a closed position.

If the user desires to filter large particulate material out of the material being drawn into the vacuum cleaner 30, the user may install a mesh collection bag 370 into the tank 32 (FIG. 16). Referring to FIGS. 17, 18A, and 18B, the mesh collection bag 370 includes a filter section 378, a closure flap 380, and an inlet collar 382. The filter section 378 includes a front portion 384 and a back portion 386. Three edges 388*a–c* of the front and back portions 384, 386 are permanently connected together. The closure flap 380 is an elongated section of the back portion 386 of the filter section 378 and is disposed opposite a fourth edge 389 of the front portion 384 to form an opening 391. The dimensions of the apertures in the mesh of the filter section 378 are preferably approximately 0.5 mm by 1 mm. The filter section 378 is made from nylon or other material which is strong and not water soluble. The filter section 378 is generally rectangular in shape and is sized so that the bottom of the filter section 378 just touches the bottom of the tank 32 when installed (FIG. 16). The inlet collar 382 includes a first and second portion 393*a*, 393*b* (FIGS. 18A and 18B). The first portion 393*a* of the inlet collar 382 is a rigid reinforcement piece, which may be made of a hard plastic material, which defines an opening 397 and is centered on an outer surface 395 of the closure flap 380 (FIG. 18B). The second portion 393*b* of the inlet collar 382 is attached to the top center of the front portion 384 of the filter section 378 and defines an opening 399 (FIG. 18A). The second portion 393*b* of the inlet collar 382 has a gummy flexible sleeve 392, which may be made of a rubber material, and a rigid reinforcement portion 394, which may also be made of a hard plastic material, with the sleeve 392 being sandwiched between the reinforcement portion 394 and the front portion 384 of the filter section 378. To install the mesh collection bag 370, the user first folds the closure flap 380 over the opening 391 and the fourth edge 389 of the front portion 384. The user then places the mesh collection bag 370 into the tank 32 and spreads the mesh collection bag 370 around the inner circumference of the tank 32 (FIG. 16). The user then aligns the openings 397, 399 of the inlet collar 382 with the inlet 40 of the tank 32 and slides the inlet collar 382 over the inlet 40. The flexible sleeve 392 will stretch outward as the inlet collar 382 is pushed onto the inlet 40. Once the inlet collar 382 is in place, the sleeve 392 has a diameter small enough and is made from a material gummy enough to securely grip the inlet 40. Finally, to complete preparation of the vacuum cleaner 30 for wet mode operation, the user inserts the combined upper vacuum assembly 34/pump adapter assembly 306 into the tank 32 and then secures the lid 44 to the lank 32 with the latches 52 as described above (FIG. 16).

Figure 19A:
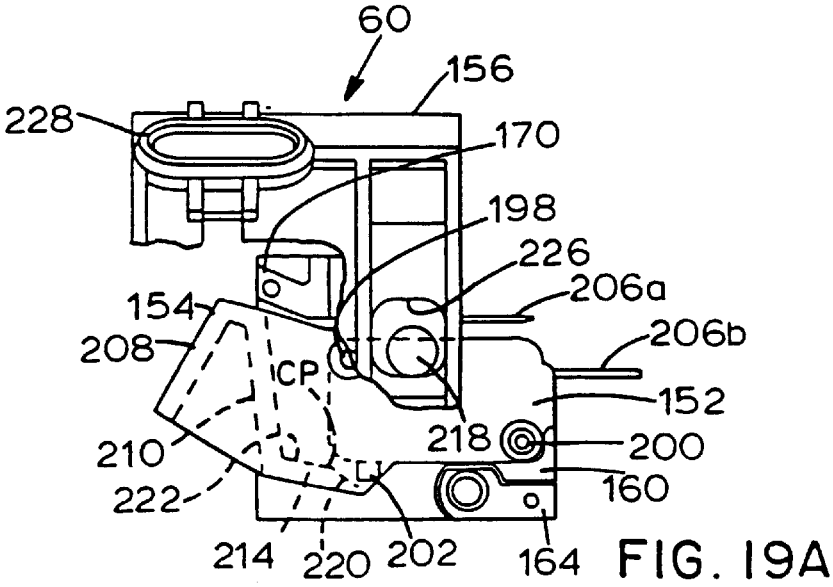
FIG. 19A is a partial front view, partially broken away and partially in phantom, of the switch actuation assembly in an "OFF" position.
Figure 19B:
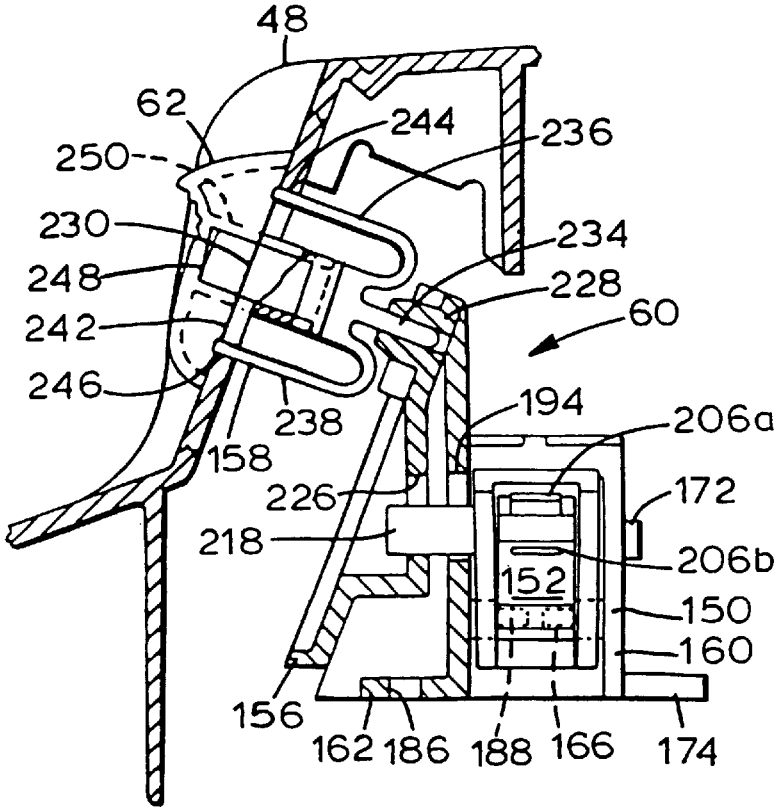
FIG. 19B is a partial side view, partially in section and partially in phantom, of the switch actuation assembly in an "OFF" position.
Figure 20B:
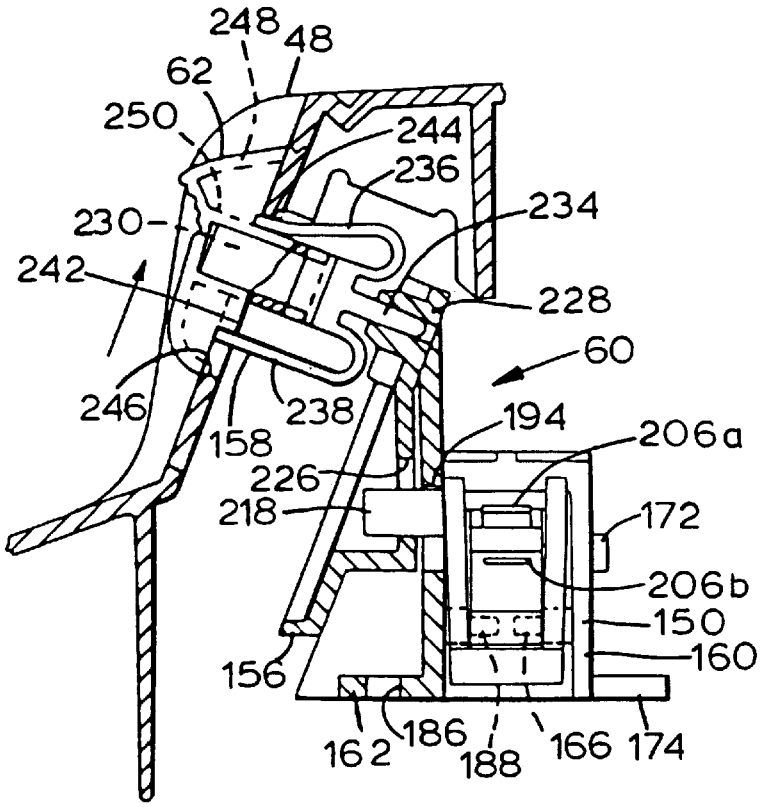
FIG. 20B is a partial side view, partially in section and partially in phantom, showing the switch actuation assembly transitioning from the "OFF" to the "ON" position.
Figure 21A:
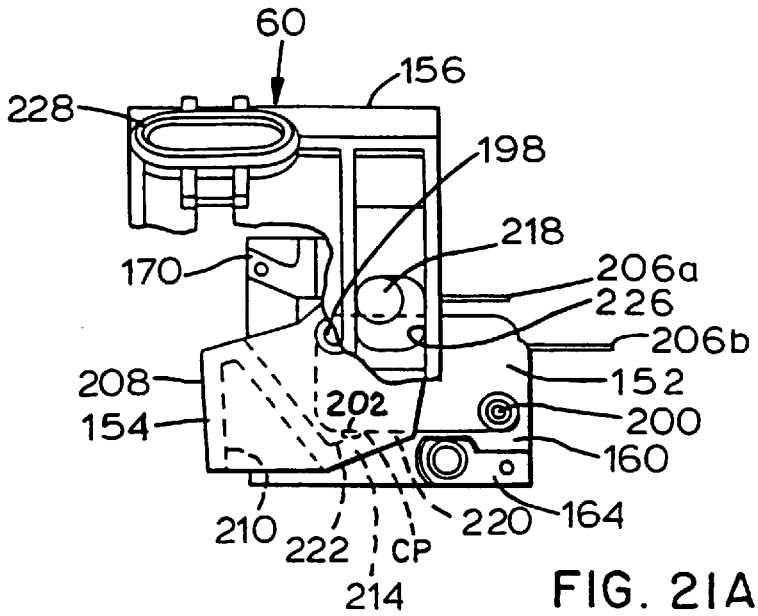
FIG. 21A is a partial front view, partially broken away and partially in phantom, of the switch actuation assembly in an "ON" position.
Figure 21B:
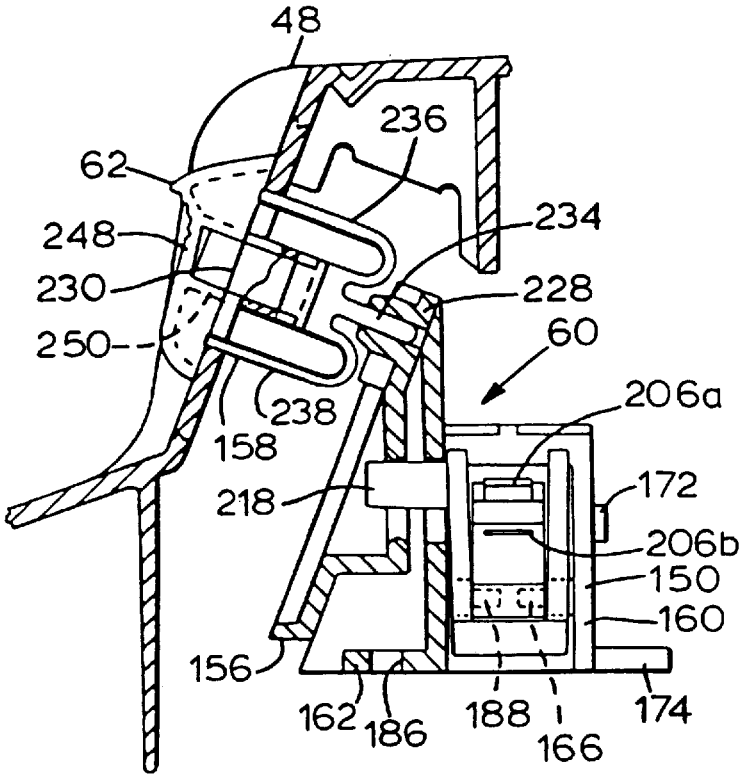
FIG. 21B is a partial side view, partially in section and partially in phantom, of the switch actuation assembly in an "ON" position.

To operate the vacuum cleaner 30 in wet mode operation (operation of the switch actuation assembly 60 is the same for dry mode operation), the user first turns the motor 93 "ON" by turning the switch 152 "ON". The switch actuation assembly 60 is initially in the "OFF" position as illustrated in FIGS. 19A and 19B. In the "OFF" position, the locking brace 214 of the toggle 154 is not engaging the momentary actuator 202 and the user engageable actuator 62 is centered in the slot 242 by the equally balanced upper and lower springs 236, 238. As illustrated in FIGS. 20A and 20B, to turn the motor 93 "ON", the user presses upward on the engageable portion 248 of the user engageable actuator 62. The upward force is transmitted to the spring member 158 and to the link 156. The upward force on the spring member 158 presses the upper spring 236 against the top lip 244 of the slot 242, creating a load. The upward force on the link 156 moves the boss slot 226 upward. As the boss slot 226 moves upward, the boss slot 226 engages the boss 218 of the toggle 154. Continued upward movement of the boss slot 226 moves the boss 218 upward and causes the toggle 154 to rotate counter-clockwise (as seen in FIGS. 20A and B) around the toggle axle 190 (FIG. 6). The top of the opening 194 in the switch cover 162 keeps the user from pulling the boss 218 too far upward and prevents possible damage to the switch 152 by keeping the toggle 154 from pressing too far upward on the switch 152. The counter-clockwise rotation of the toggle 154 moves the ramp portion 220 into engagement with the momentary actuator 202, pressing the momentary actuator 202 into the switch 152. Continued counter-clockwise rotation of the toggle 154 slides the ramp portion 220 laterally along the momentary actuator 202. Eventually, the momentary actuator 202 passes the critical point CP and comes in contact with the locking portion 222 of the locking brace 214. At this point, the momentary actuator 202 is no longer resisting the counter-clockwise rotation of the toggle 154; lather, the momentary actuator 202 is now locking the toggle 154 against the switch 152 by pushing downward on the locking brace 214, causing the momentary actuator 202 to remain depressed (FIGS. 20A and 20B). The depressed momentary actuator 202 turns the switch 152 "ON", which in turn supplies power to the motor 93. Once the user releases the user engageable actuator 62, the load created on the upper spring 236 is released, and the spring member 158 re-centers the user engageable actuator 62 in the slot 242 (FIGS. 21A and 21B).

The energized motor 93 simultaneously turns the air impeller 74 and the pump impeller 104 via the motor shaft 76/shaft extension 78 combination (FIG. 16). The rotating air impeller 74 reduces the pressure in the tank 32, creating a vacuum. The vacuum draws air, liquid and/or other material into the tank 32 through the inlet 40. As material is sucked into the tank 32 through the inlet 40, the mesh collection bag 370 filters out any exceptionally large particulate material to reduce the possibility of clogging the pump 372. Even if the pump 372 is not used, the mesh collection bag 370 can be used to easily filter large particulate material out from the liquid in the tank 32 so that when the tank 32 is poured or emptied into a drain the large particulate material will not clog the drain. The air that is drawn into the tank 32 passes through the foam filter 116, through the lid cage 106, into the motor housing 46, and finally is expelled out of the discharge slots 54 (FIG. 1).

The pump 372 is a self-priming pump under most conditions. Referring to FIGS. 15C and 16, when the ball 340 seats in the opening 342 a high-pressure system is created in the passageway 284, the flexible tube 360, and the conduit 314 by air under atmospheric pressure being trapped between the closed ball valve 58 (FIG. 12A) and the liquid collecting in the hollow body 336 of the pressure differential apparatus 312. Meanwhile, a low pressure system is created in the inlet tubes 310, 318 since the gap 140 in the upper impeller housing 124 places the inlet tubes 310, 318 in communication with the low-pressure area created by the air impeller 74. The low-pressure air trapped in the inlet tubes 310, 318 does not create enough head to pull the liquid collected in the hollow body 336 up through the inlet tubes 310, 318 to prime the pump 372. The check valve 364 acts to keep the low-pressure system created in the inlet tubes 310, 318 separate from the high-pressure system created in the passageway 284, the tube 360, and the conduit 314. The high-pressure system and the low-pressure system act together to create a pressure differential across the liquid in the hollow body 336 by the high-pressure (essentially atmospheric) air pushing the liquid in the hollow body 336 up through the inlet tubes 310, 318 and into the priming chamber 374, displacing the low-pressure air and priming the pump 372.

The primed pump 372 will then pump the collected liquid out of the tank 32. The liquid collected in the tank 32 will flow from the tank 32 through the filter 358 into the hollow body 336, up the inlet tubes 310, 318, into the priming chamber 374 and up to the pump impeller 104. Some of this liquid will splash through the gap 140, but the majority of this liquid will flow downward into the discharge recess 376, past the check valve 364, and into the outlet section 256. The O-ring 324 will prevent any liquid from leaking between the interface of the outer annular wall 320 of the pump fitting 308 and the outer annular wall 136 of the lower impeller housing 126. Once in the outlet section 256, the liquid will flow through the pump connector 334, the tube 360, the rotatable connector 362, the passageway 284, the passageway 280, and out the pump outlet 56 through the hose 302, if connected, to a drainage source (not depicted). Once primed, the user can turn the knob 274 so that the dog 276*c* is aligned with the pump outlet 56, thus putting the passageway 280 in alignment with the passageway 284 to permit the liquid to discharge at a maximum flow rate (FIG. 12C). This self-priming action of the present invention is a unique aspect of this design.

If conditions are such that the pump 372 will not self-prime, the user may enable the priming system by rotating the knob 274 to its 45° position so that dog 276*b* aligns with the pump outlet 56 (FIG. 12B). The relatively high-pressure outside air, at atmospheric pressure, will enter the inlet 266 (FIGS. 10 and 11) and fill the passageway 284, the flexible tube 360, and the conduit 314, creating a high-pressure system like the one described above. This high-pressure system will create a pressure differential across the liquid in the hollow body 336 and prime the pump 372 in the same manner as described above.

Another unique design feature of the present invention is that the pump 372, once primed, is not likely to lose its prime due to deterioration of the O-ring 322. When the pump 372 is pumping liquid out, the O-ring 322, which forms a seal between the upper inlet tube 318 and the inner annular wall 134 of the lower impeller housing 126, is surrounded by liquid on both sides because both the priming chamber 374 and the discharge recess 376 are filled with liquid. As such, even if the O-ring 322 begins to deteriorate, air will not be able to enter the priming chamber 374 and cause the pump 372 to lose its prime. The pump 372 will, however, operate less efficiently in this situation.

Referring to FIGS. 16 and 23–25, if, while vacuuming, the level of the liquid in the tank 32 gets too high, the mechanical shut-off and override assembly 144 will automatically shut-off the motor 93. When the liquid in the tank 32 gets to the level of the float 148, the liquid pushes the float 148 upward. Simultaneously, the float 148 pushes the float rod 146 upward in the rod receiving extension 210 of the toggle 154. Eventually, the rising liquid reaches a level high enough to create an upward force so that the float rod 146 pushes the toggle 154 clockwise, disengaging the toggle 154 from the switch 152. Once the toggle 154 is disengaged from the switch 152, the momentary actuator 202, due to the force of the internal spring 204, springs outward turning the switch 152 "OFF" (FIGS. 24A and 24B) which stops the motor 93 and, consequently, stops the air impeller 74 and the pump impeller 104 from rotating. The float 148 should be placed at a height low enough so that the motor 93 is turned "OFF" before the level of liquid is high enough to begin entering the air impeller 74. Once the motor 93 has been turned "OFF", the user has two options: the user may either remove the upper vacuum assembly 34 and manually empty the tank 32 or the user may bypass the float shut-off by mechanically overriding the float shut-off.

To manually empty the tank 32, the user unfastens the latches 52 and lifts off the upper vacuum assembly 34. While lifting the upper vacuum assembly 34, the motor 93 will not inadvertently turn "ON". The present invention has a number of design features incorporated within it to keep the toggle 154 from re-engaging the momentary actuator 202, which would cause the motor 93 to turn "ON", while the upper vacuum assembly 34 is being lifted from the tank 32. First, the toggle 154 is intentionally not connected to the float rod 146. If the toggle 154 was formed integral with the float rod 146, the float rod 146 would cause the toggle 154 to rotate counter-clockwise while the upper vacuum assembly 34 was being lifted and would possibly re-engage the momentary actuator 202. Second, the outward force of the internal spring 204 of the switch 152 is enough to keep the toggle from inadvertently depressing the momentary actuator 202 while the upper vacuum assembly 34 is being lifted. Once the upper vacuum assembly 34 is removed, the user lifts the tank 32, removes the mesh collection bag 370, and dumps the contents of the tank 32 into a drainage source.

Figure 25A:
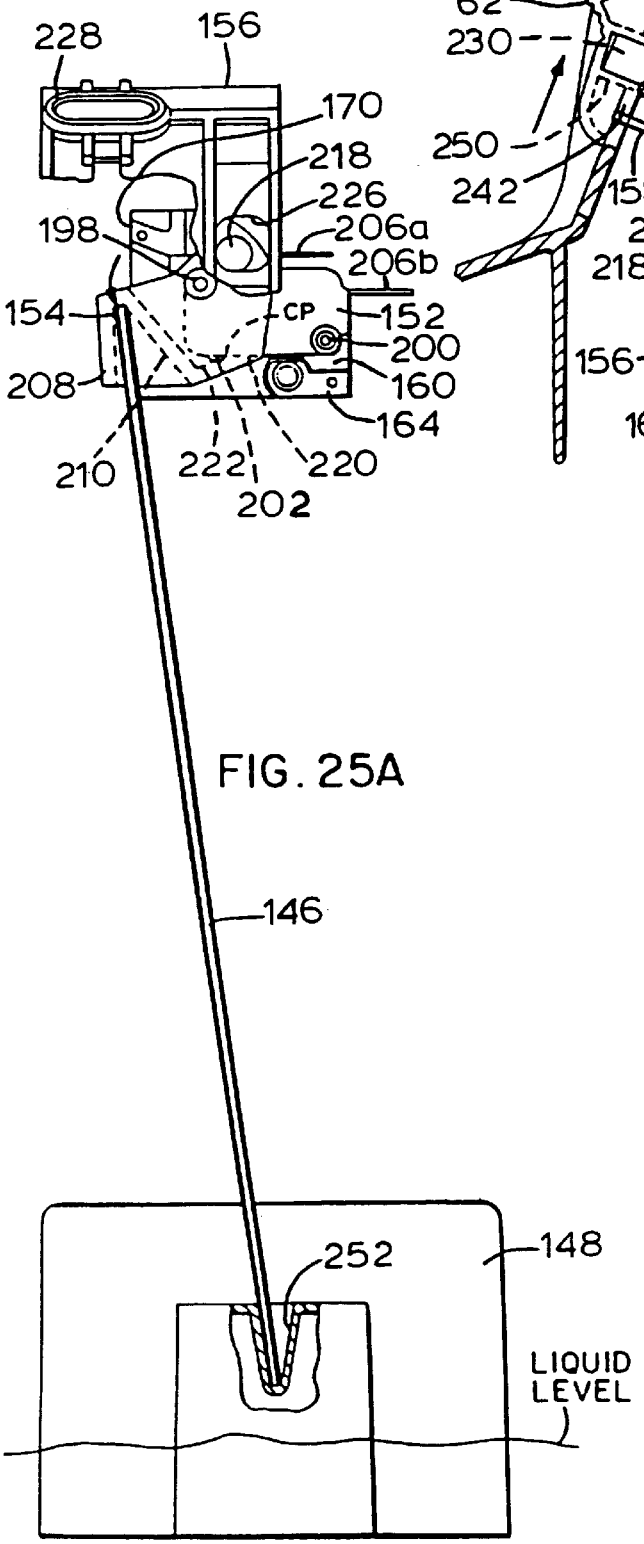
FIG. 25A is a partial front view, partially broken away and partially in phantom, showing the mechanical shut-off and override assembly bypassing the mechanical shut-off.
Figure 25B:
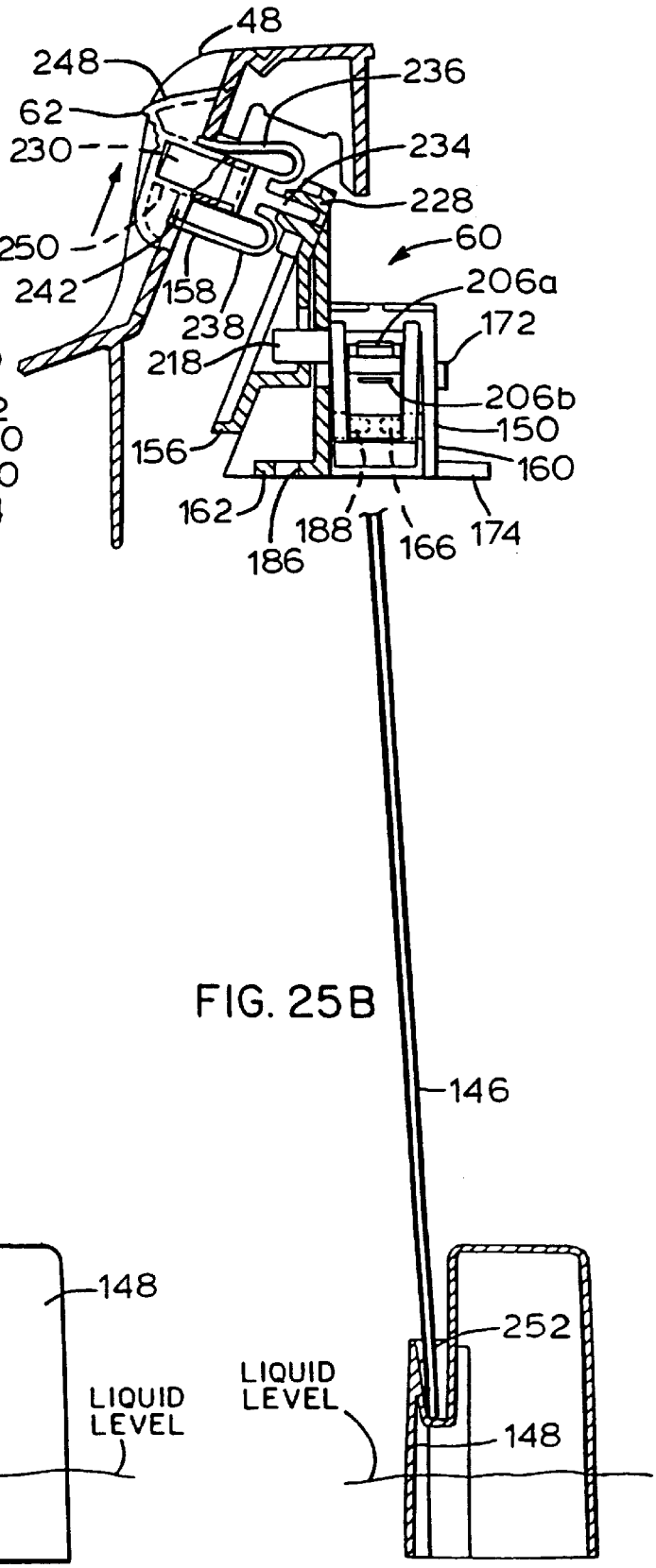
FIG. 25B is a partial side view, partially in section and partially in phantom, showing the mechanical shut-off and override assembly bypassing the mechanical shut-off.

Instead of dumping the contents of the tank 32, the user may mechanically bypass the float shut-off, by pushing upward on the user engageable actuator 62 (FIGS. 25A and 25B). As discussed above, the upward movement of the user engageable actuator 62 moves the boss 218 upward which causes the toggle 154 to rotate counter-clockwise. The toggle 154 rotates into contact with and depresses the momentary actuator 202 again. Once the momentary actuator 202 is depressed, the motor 93 turns back "ON", and the user can continue pumping liquid out of the tank 32. However, in this situation, the user must hold the user engageable actuator 62 upward until a sufficient amount of liquid has been pumped out of the tank 32 so that the liquid level is below the motor shut-off level; otherwise, the liquid will continue to push the float 148 upward which will push the toggle 154 clockwise again, turning the motor 93 "OFF". Once the user has pumped out enough liquid to put the liquid level in the tank 32 below the motor shut-off level, the motor 93 will stay "ON" when the user releases the user engageable actuator 62, and the user may resume normal operation of the vacuum cleaner 30.

Figure 22A:
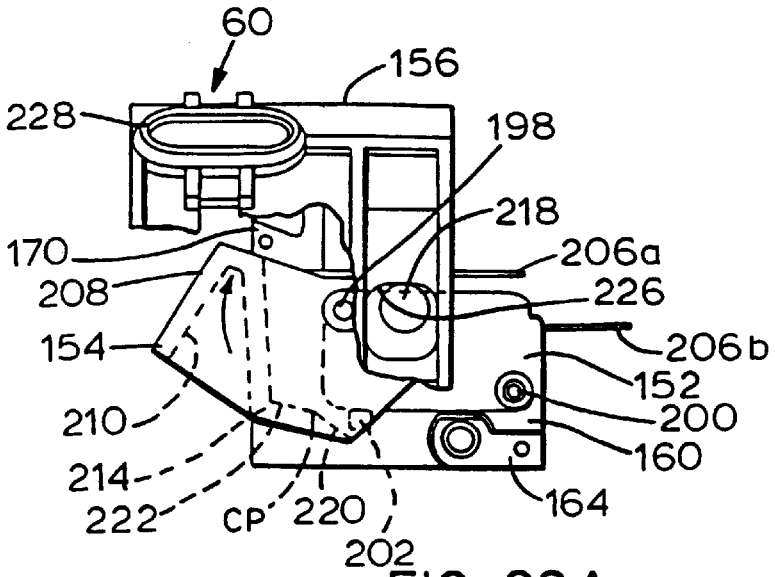
FIG. 22A is a partial front view, partially broken away and partially in phantom, showing the switch actuation assembly transitioning from the "ON" to the "OFF" position.
Figure 22B:
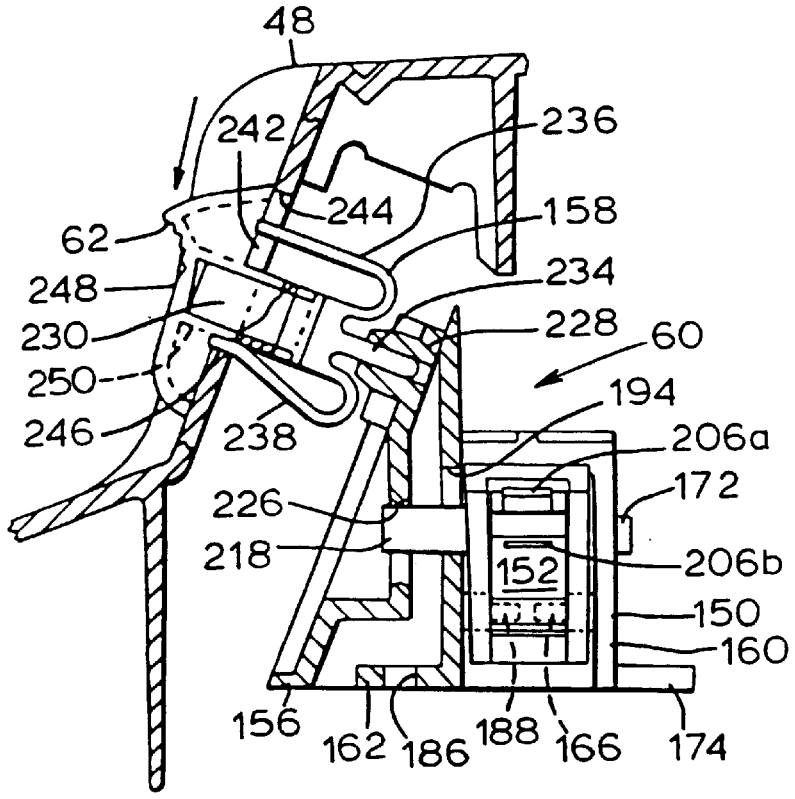
FIG. 22B is a partial side view, partially in section and partially in phantom, showing the switch actuation assembly transitioning from the "ON" to the "OFF" position.
Figure 23A:
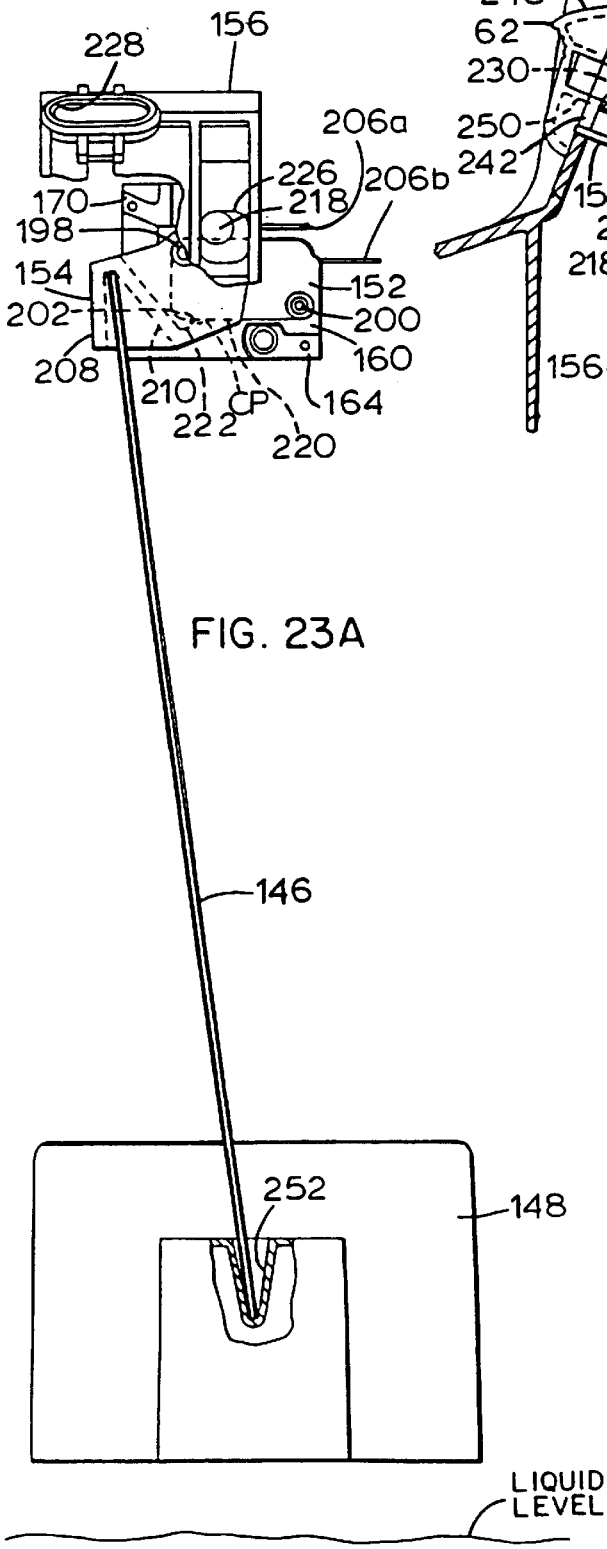
FIG. 23A is a partial front view, partially broken away and partially in phantom, of a mechanical shut-off and override assembly of the present invention in an "ON" position.
Figure 23B:
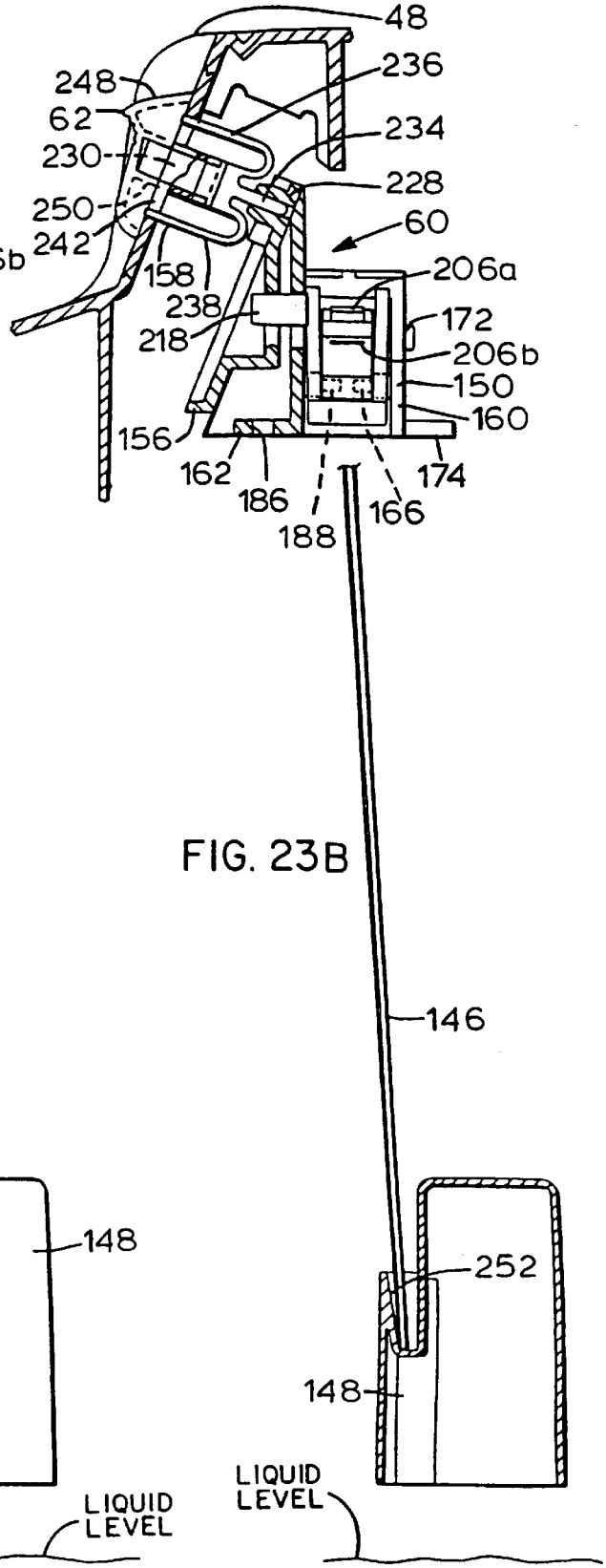
FIG. 23B is a partial side view, partially in section and partially in phantom, of the mechanical shut-off and override assembly in an "ON" position.
Figures 24A, 24B:
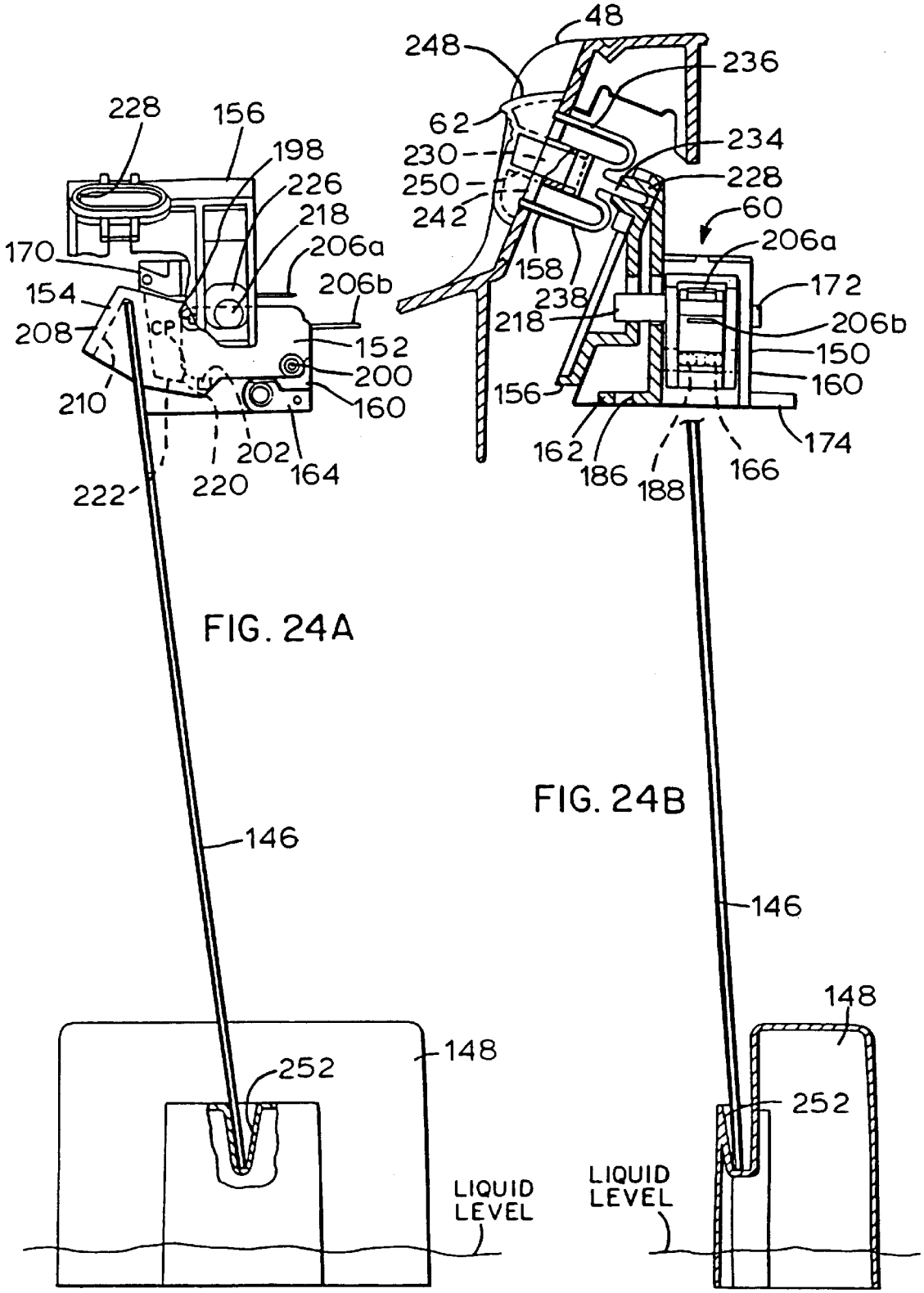
FIG. 24A is a partial front view, partially broken away and partially in phantom, of the mechanical shut-off and override assembly moved to the "OFF" position due to an excessively high liquid level.
FIG. 24B is a partial side view, partially in section and partially in phantom, of the mechanical shut-off and override assembly moved to the "OFF" position due to an excessively high liquid level.

When the user is finished either vacuuming or pumping with the vacuum cleaner 30, the user turns the vacuum cleaner 30 "OFF" by pushing downward on the user engageable actuator 62 (FIGS. 22A and 22B). The downward force is transmitted to the spring member 158 and to the link 156. The downward force on the spring member 158 presses the lower spring 238 against the bottom lip 246 of the slot 242, creating a load. The downward force on the link 156 moves the boss slot 226 downward. As the boss slot 226 moves downward, the boss slot 226 engages the boss 218 of the toggle 154. Continued downward movement of the boss slot 226 moves the boss 218 downward and causes the toggle 154 to rotate clockwise around the toggle axle 190 (FIG. 6). The bottom of the opening 194 in the switch cover 162 and the toggle stop 170 keep the toggle 154 from traveling too far backward. The clockwise rotation of the toggle 154 disengages the locking brace 214 from the momentary actuator 202. As such, the internal spring 204 of the switch 152 pushes the momentary actuator 202 outward and turns the switch 152 "OFF", which in turn shuts off the motor 93. Once the user releases the user engageable actuator 62, the load created on the lower spring 238 is released, and the spring member 158 re-centers the user engageable actuator 62 in the slot 242 (FIGS. 19A and 19B).

The vacuum cleaner of the present invention has significant advantages over prior vacuum cleaners. By providing a pump to remove liquid from the tank, liquid can be emptied easily into drains at a variety of heights. Driving the pump impeller off of the same motor which drives the air impeller significantly reduces the cost of the vacuum cleaner over designs which require a separate motor for the pump. By locating the pump in the tank directly below the air impeller, the pump impeller can be simply and efficiently driven off a single axle connected to the air impeller. Removability of the pump adapter assembly provides significant efficiency when the vacuum cleaner is used on dry material.

The mechanical shut-off and override assembly of the present invention also provides significant advantages. The mechanical shut-off and override assembly automatically shuts off the motor when the liquid level in the vacuum cleaner tank gets too high. This assembly then allows the user to bypass the vacuum cleaner mechanical shut-off and continue to pump liquid out of the tank without requiring the user to lift or tilt the tank to empty it. Also, the priming assembly of the present invention provides a simple, easy to use, and cost effective priming system.

The foregoing detailed description has been given for clearness of understanding only, and no unnecessary limitations should be understood therefrom, as modifications would be obvious to those skilled in the art.

I claim:

1. A vacuum cleaner comprising:

an air impeller for creating low pressure in the vacuum cleaner;

a tank communicating with the air impeller;

a tank inlet; and a collection bag comprised of a material that is not water soluble, and connected to the tank inlet, wherein the collection bag has a filter section and a closure flap connected to the filter section.

2. The vacuum cleaner of claim 1 wherein the collection bag is comprised of a nylon mesh.

3. The vacuum cleaner of claim 1 comprising a pump impeller for pumping material out of the tank.

4. A vacuum cleaner comprising:

an air impeller for creating low pressure in the vacuum cleaner;

a tank communicating with the air impeller;

a tank inlet; and a collection bag connected to the tank inlet, wherein the collection bag is comprised of a material that is not water soluble, and includes a filter section; a closure flap connected to the filter section; and an inlet collar attached to the filter section.

5. The vacuum cleaner of claim 4, wherein:

the inlet collar includes a flexible sleeve and a reinforcement portion wherein the flexible sleeve is sandwiched between the filter section and the reinforcement portion, and the flexible sleeve slides over the inlet.

6. The vacuum cleaner of claim 1, in which the collection bag comprises a collar which is attached to the tank inlet.

7. The vacuum cleaner of claim 6, in which the collar comprises a resilient collar.

8. The vacuum cleaner of claim 7, in which the resilient collar comprises a first rigid reinforcement piece attached to the closure flap and defining a first opening, and a flexible sleeve secured to the filter section and defining a second opening, the closure flap being foldable over the filter section so that the first and second openings are superposed.

9. The vacuum cleaner of claim 8, in which the flexible sleeve comprises a rubber material.

10. The vacuum cleaner of claim 8, in which the resilient collar further comprises a second rigid reinforcement piece attached to the filter section and over the flexible sleeve thereby to secure the flexible sleeve to the filter section.

11. The vacuum cleaner of claim 10, in which the first and second reinforcement pieces comprise a hard plastic material.

* * * * *